United States Patent [19]

Diesner

[11] Patent Number: 4,577,665

[45] Date of Patent: Mar. 25, 1986

[54] NARROW-FABRIC NEEDLE LOOM WEAVING SYSTEM

[75] Inventor: Willi Diesner, Wuppertal, Fed. Rep. of Germany

[73] Assignee: Petig Corporation, Pittsfield, N.H.

[21] Appl. No.: 539,966

[22] Filed: Oct. 7, 1983

[51] Int. Cl.[4] ..... D03D 47/42

[52] U.S. Cl. ..... 139/431; 139/91; 139/104; 139/452

[58] Field of Search ..... 139/55.1, 79, 83, 89, 139/82, 431, 432, 442, 449, 450, 452, 91, 97, 98, 99, 100, 101, 102, 103, 104, 105, 106, 107, 108, 109

[56] References Cited

U.S. PATENT DOCUMENTS

| | | | |
|---|---|---|---|
| 651,744 | 6/1900 | Caldwell | 139/104 |
| 1,589,181 | 6/1926 | Lane et al. | 139/100 |
| 3,104,683 | 9/1963 | Weiner | 139/431 |
| 3,339,590 | 9/1967 | Libby | 139/452 |
| 3,369,572 | 2/1968 | Libby | 139/431 |
| 3,929,170 | 12/1975 | Muller | 139/431 |
| 3,949,788 | 4/1976 | Speich | 139/79 |
| 4,305,434 | 12/1981 | Muller | 139/431 |

FOREIGN PATENT DOCUMENTS

| | | | |
|---|---|---|---|
| 48-27219 | 8/1973 | Japan | 139/452 |

*Primary Examiner*—Henry S. Jaudon
*Attorney, Agent, or Firm*—Charles W. Helzer

[57] ABSTRACT

An automatic narrow-fabric needle loom weaving system employing a hook secured to the mounting plate of the loom on the side thereof into which the needle enters the shed and around which the weft thread is wound in order to form a straight edge without contraction of the warp threads during beat-up on the side of the woven material opposite the knitted selvage edge produced by a latching needle pick. An improved weft thread feed is provided with a simple, relatively inexpensive mechanical drive disk that can be easily adjusted to vary the amount of weft thread fed during each pick. A weft thread support spring structure provides tensioning support for the weft thread and reduces wear on the leaf spring members. An improved header frame assembly prevents undesired twisting of the header elements and makes it easier for a technician to change the machine over from one weaving pattern to the next. Eccentrically mounted drive disks are provided for the respective sets of oppositely reciprocated header frames. A lever arm adjustable drive is provided for the take-up roll which simplifies the problem of adjusting the number of picks provided for a given length of woven material during loom operation. A drive for the latching needle of the loom also is provided which provides a horizontal reciprocating motion to the latching needle in a simple manner. A spring biased braking arrangement for braking rotation of the warp beam supplying warp thread from the supply spool also is made available.

53 Claims, 20 Drawing Figures

88
87
36
20
24
89
85
37
91
41
93
92
24
38
83
10
86
42
74
75
37

85
24
37
38
42
86

24
89
36
37
38
86
24
91
24
91
42
24A
92
41
93

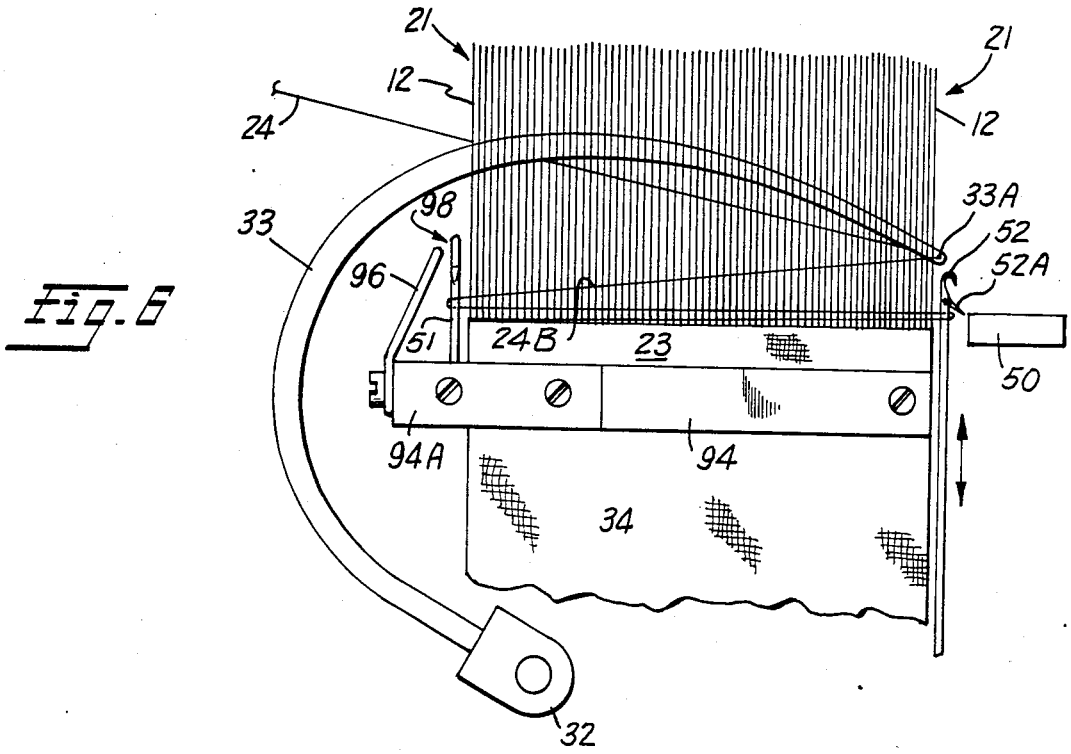
Fig. 6
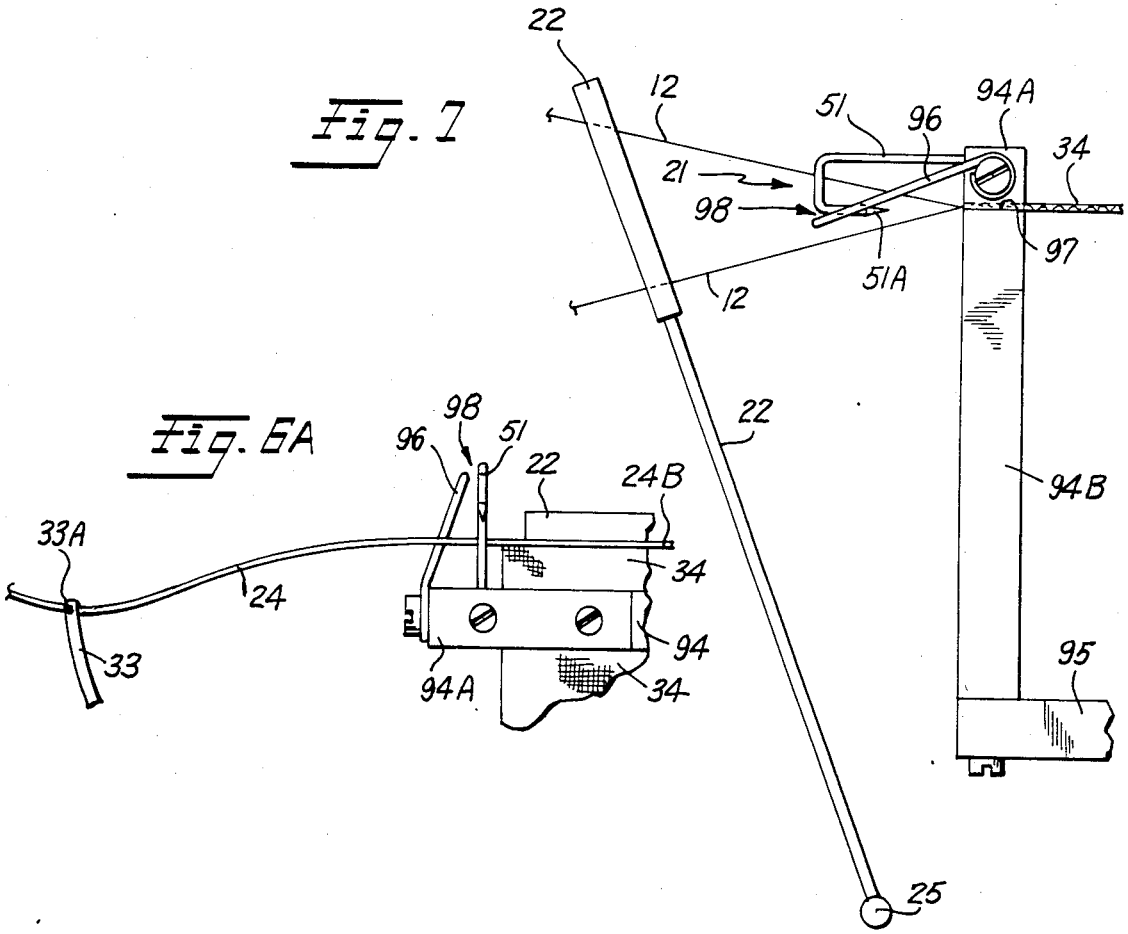
Fig. 7
Fig. 6A

Fig. 8
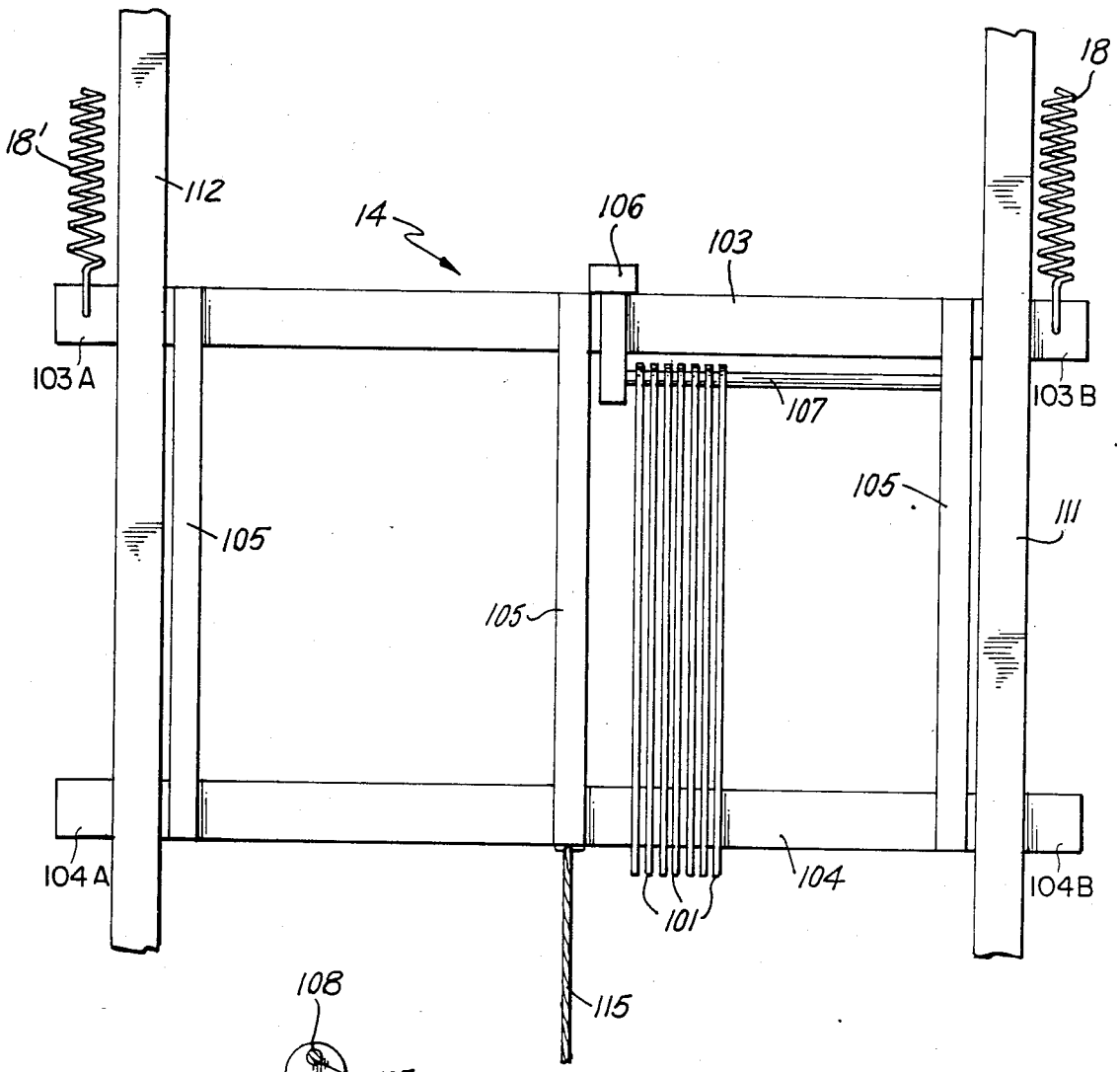
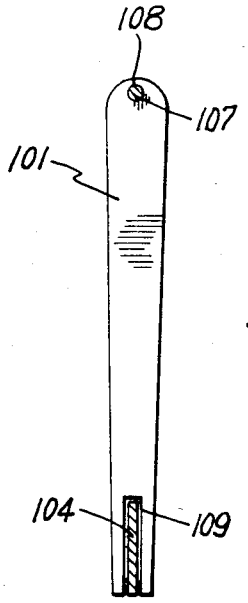
Fig. 8A

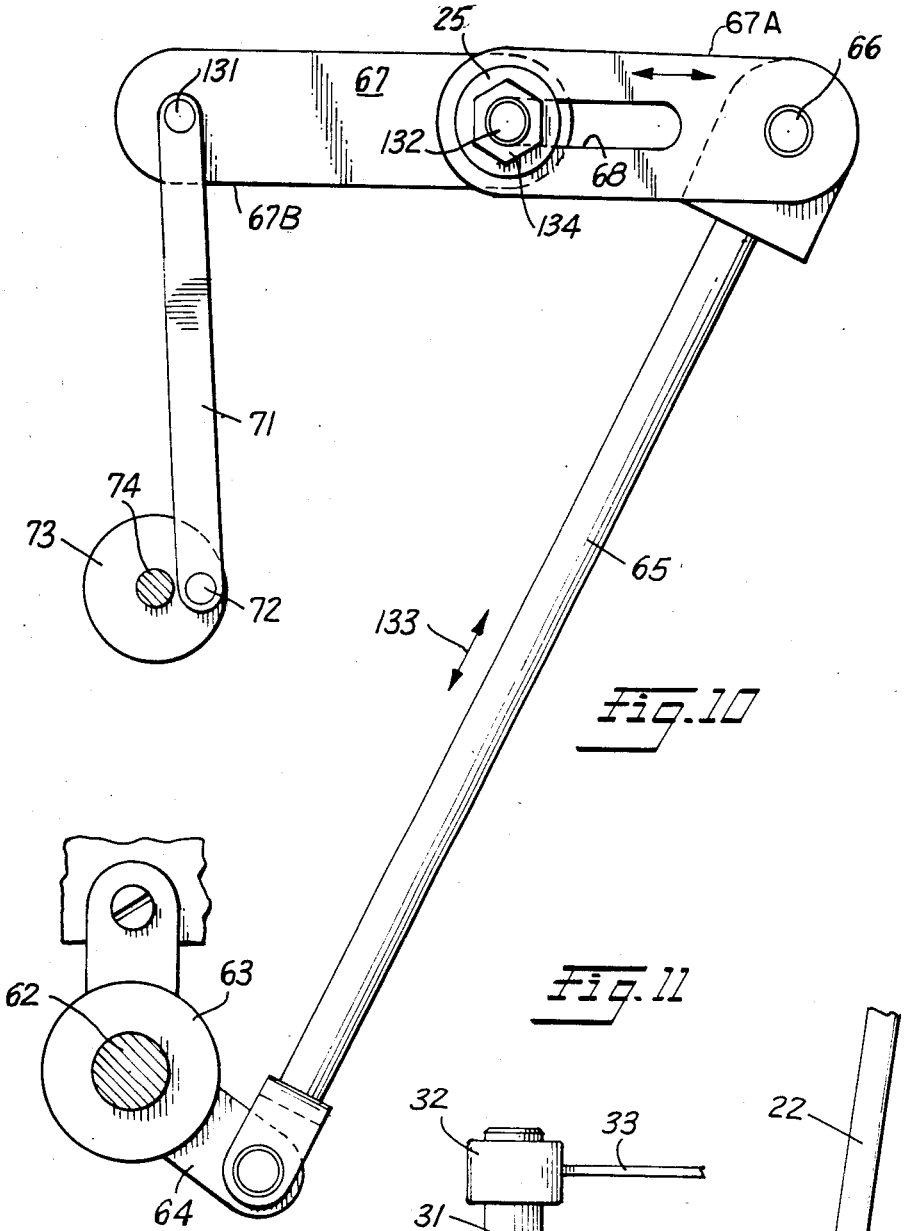
Fig. 10
Fig. 11
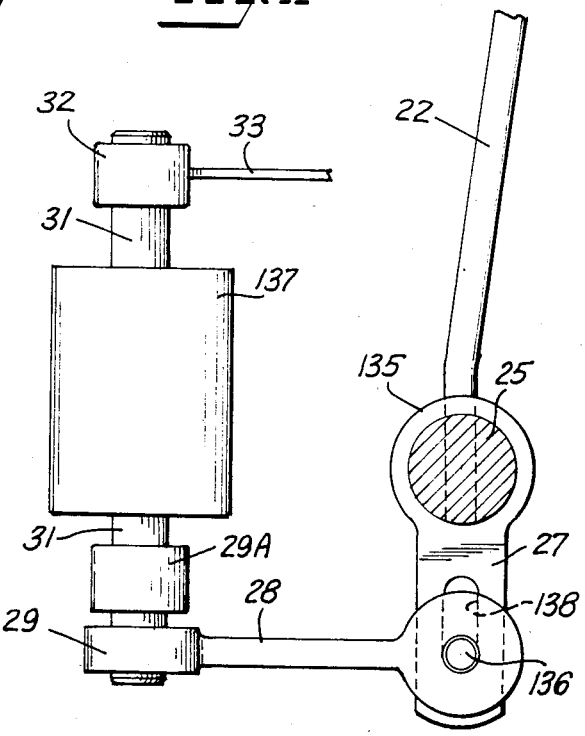

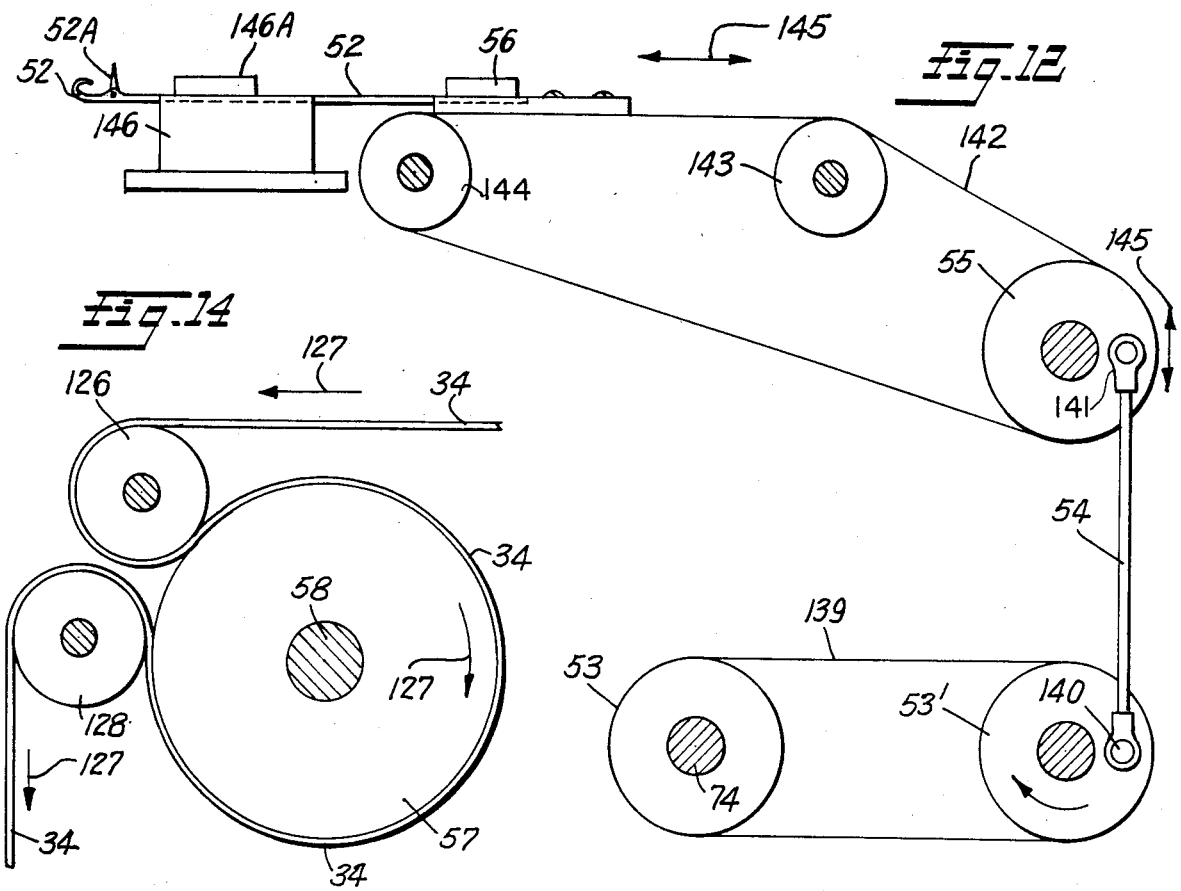
Fig. 12
Fig. 14
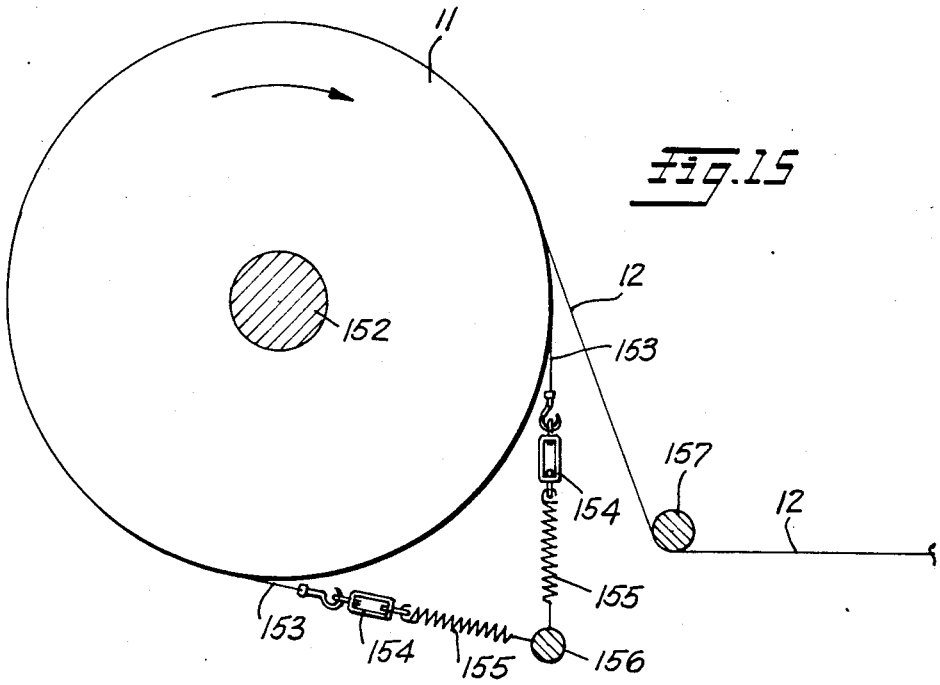
Fig. 15

NARROW-FABRIC NEEDLE LOOM WEAVING SYSTEM

TECHNICAL FIELD

This invention relates to an improved narrow-fabric needle loom weaving system, and particularly to looms of the type used for weaving ribbons, belts, labels and other similar narrow woven fabrics.

BACKGROUND PRIOR ART

In the past narrow fabric needle looms have employed either a small wire around which the weft thread is wound during weaving by the needle as it enters the shed and which runs continuously along one side of the narrow woven fabric. The use of such a wire woven into the narrow fabric does provide to a certain extent a satisfactorily straight selvage. Other known looms employed a pointed plate secured to the mounting block of the loom which defines the gap through which woven material passes as it leaves the shed. In such arrangements, the pointed plate has a downwardly extending point formed thereon projecting outwardly from the mounting block a distance of a few millimeters with the point on the plate also serving to hold the weft thread in a desired position where a selvage is to be formed on the woven material as the needle enters the shed. Both of these known arrangements have not proven entirely satisfactory due in part to the requirement of the need for additional material in the form of a wire, which must not be either too small or too large and in the case of the pointed plate, its displacement outwardly from the mounting block is too great to assure formation of a straight selvage along the length of the woven narrow fabric.

Further, prior know automatic narrow-fabric needle looms feed the weft thread continuously as the needle holding the weft thread is reciprocated in and out of the shed during the weaving process. However, consumption of the weft thread during weaving is not continuous. As the needle swings into the shed, temporarily there is a great demand for thread. When the needle swings back and while out of the shed, the demand for weft thread is very low or substantially none. Therefore, between the weft thread feed and the needle a mechanism must be provided by which the weft thread is held with suitable tension during such irregular consumption of the weft thread.

In prior known devices, weft thread feed is effected by two rubber-coated cylindrical rollers which are in contact with each other and accommodate the weft thread between them. One cylindrical roller is motor driven while the second roller is spring biased into engagement with the first roller so that it is caused to follow the first roller. Both cylindrical rollers have the same diameter so that rotating speed of the driven cylindrical roller must be changed in order to adjust the weft thread feed to the demand. For this purpose, the driven cylindrical roller requires a motor use rotating speed can be infinitely variable and is therefore somewhat expensive.

In addition to the above, known prior art weaving looms employ serially arranged reciprocating header frame assemblies to form the shed during weaving. The known header assembly designs are difficult to change in order to accommodate programming of the loom to weave a different pattern and further employ header elements which sometimes can be swivelled in their mount due to warp tension. When thus swivelled, the header elements tend to remain in the swivelled condition causing abnormal wear on the warp threads and possible breakage. Additionally, the machinery for reciprocating the serially arranged header assemblies up and down in known looms requires somewhat heavy linkages and couplings which are complex in design and difficult to maintain because of wear.

Another problem encountered with known narrow fabric needle looms concerns the difficulty in altering the weaving process to provide a different number of picks of the weft for a given length of woven material. With known looms, considerable breakdown of the linkages driving the needle, reed and take-up roll, all of which movements must be properly synchronized, require considerable time and work on the part of a technician to accommodate such changes in the number of picks provided for length of woven material.

During weaving at the point in the movement of the needle where it is entirely within the shed, a weaving needle picks off a length of the weft thread to perform what is known as a pick. For this purpose, latching needles have been used in the past as described in German Pat. No. 2940704 published Apr. 17, 1980, for example. The present invention provides an improved reciprocating latching needle drive which is coordinated with the movement of the needle in a simple and expeditious manner.

In prior known needle loom weaving systems, the warp spool for supplying warp thread to the loom has been braked through the use of weights which are depended from the peripheral edges of the spool or the spool supports with the weights used being gauged to provide a desired amount of warp thread tension. This arrangement, while it works, has some disadvantages in that it causes a jerking rotational motion of the warp spool which is not altogether satisfactory.

SUMMARY OF INVENTION

It is therefore a primary object of the present invention to provide a new and improved narrow-fabric needle loom weaving system which employs a novel arrangement of a hook secured to the mounting plate of the loom on the side thereof into which the needle enters the shed and around which the weft thread is wound in order to form a selvage edge on that respective side of the woven material thereby obviating the need for wires and the like and overcoming the undesirable characteristics of the hook plate arrangement described earlier.

Another object of the invention is to provide a novel automatic weft thread feed which is effected with a simple, relatively inexpensive mechanical arrangement that is easily adjusted to vary the amount of weft thread fed during each pick.

Another object of the invention is to provide an improved weft thread support spring structure which provides tensioning support for the weft thread during movement of the needle into and out of the shed and which reduces wear on the leaf spring member comprising a part of the improved structure.

Still another object of the invention is to provide an improved header frame assembly construction which prevents undesired twisting of the header element and also makes it much easier for a technician to change the machine over from one weaving pattern to the next by facilitating removal and replacement of the header frame elements.

Still another object of the invention is to provide an improved, simple, and relatively inexpensive eccentric drive for the header element which simplifies and reduces cost of the overall needle loom weaving system as well as to cut down on maintenance problems normally encountered with this part of the system.

A further object of the invention is to provide a novel lever arm adjustable drive for the take-up spool of the needle loom weaving system which simplifies the problem of adjusting the number of picks provided for a given length of woven material with the machine.

A still further object of the invention is to provide an improved reciprocating drive for the latching needle of the loom and which provides in a simple and expeditious manner a linearly reciprocating movement to the latching needle.

A still further object of the invention is to provide an improved spring biased braking arrangement for braking rotation of the warp thread supply spools employed on the loom.

In practicing the invention an improved needle loom machine for narrow width weaving is provided which includes a warp thread supply, a weft thread supply, a header sub-assembly for maintaining the warp thread spread in a predesigned pattern in forming a shed, a reciprocally movable needle for insertion of the weft thread into the shed during each successive pick, a needle-like pick for picking off a predetermined length of weft thread for the needle during each successive insertion of the needle in the shed at the far end of the travel thereof, a reed assembly and a take-up roll for withdrawing the woven material after it has been beaten-up in the beat-up region by the reed assembly. The improvement in such a needle loom machine comprises automatically feeding weft thread to the needle during reciprocal movement thereof while weaving, a hook supported on the machine on the side of the shed into which the needle enters at the near end of the travel thereof during each reciprocation, the hook having a hooked end around which the weft thread is supported while the needle is at the far end of its travel with the hooked end being terminated immediately adjacent the beat-up region whereby as the reed drives home the weft thread during beat-up, the weft thread is forced off the hooked end and is beaten-up to form a straight line selvage for the woven material. The invention also includes a novel method of weaving made possible by a machine having the characteristics noted above.

Another feature of the invention is the provision of an automatic weft thread feed which comprises a rotatable weft thread drive disk rotated synchronously with the movement of the needle and the reed, a spring loaded weft thread pressure member in pressure contact with the weft thread drive disk for engaging and moving the weft thread therebetween, and a weft thread length adjustment means immediately adjacent the weft thread drive disk and weft thread pressure member for adjusting the length of weft thread being supplied during each rotation of the weft thread drive disk.

Another feature of the invention is the provision of a weft thread additional tensioning means for providing additional tension to the weft thread during that portion of the travel of the needle while it is outside the shed.

Still another feature of the invention is the provision of an improved weaving latching needle supported on the side of the shed opposite from the hook and reciprocating in synchronism with the movement of the needle whereby a predetermined length of weft thread is picked by the reciprocating latching needle at the end of movement of the needle into the shed. The reciprocating latching needle is provided with a linear, horizontal reciprocating movement through a novel latching needle drive employing a reciprocating belt drive in turn driven by a set of opposed eccentric disk drives interconnected by a connecting rod for converting rotational motion of the main drive shaft into a linear reciprocating motion required for the latching needle.

A further feature of the invention is the provision of an improved header sub-assembly employing a rod having a circular cross sectional configuration for supporting the header frame element with the header frame elements each having slotted ends for insertion over a horizontally extending lower header frame member. By this construction the header elements may be easily removed and changed and also are prevented from tilting relative to each other due to the manner of their suspension.

Still a further feature of the invention is the provision of an improved header frame assembly eccentric drive which includes return springs for returning the respective frames of a set of two serially arranged header frames to an initial starting position, a tension cord for each respective header frame having one end secured substantially at the center of the lower horizontally extending frame and acting in opposition to the return springs. The tension cord for each header frame is wound around a respective eccentrically mounted disk drive and has the remaining end thereof secured to the machine housing. The eccentrically mounted disk drives for each set of two serially arrayed header frames are ecentrically offset at angles substantially 180 degrees apart relative to each other whereby rotation of the sets of coacting eccentrically mounted disk drives causes the respective sets of header frames to be moved in opposite directions relative to each other to thereby form the shed.

Still a further feature of the invention is the provision within the respective eccentrically mounted disk drive of circumferential surfaces for engaging respective tension cords wound therearound mounted in a bearing supported race whereby there is no relative movemcnt between the respective tension cord and the surface of the respective eccentrically mounted disk drive which it engages.

A still further feature of the invention is the provision of an improved adjustable lever take-up roll drive which provides rotational drive to the take-up roll of the loom. The improved adjustable lever take-up roll drive is designed so as to facilitate easy change over from the number of picks provided for unit of length of woven material with the improved needle loom weaving system made available by this invention.

Still another feature of the invention is the provision of an improved warp thread supply spool tensioning means for braking rotation of the warp supply spools that supply warp thread to the machine. The improved tensioning means employs adjustable tension springs surrounding the periphery of the spools or the spool hubs and extending to a suitable anchor point on the machine housing thereby adjusting the tension of the spring and resulting in smoother braking of the warp supply spools than previously obtainable with prior art arrangements.

BRIEF DESCRIPTION OF DRAWINGS

These and other objects, features and many of the attendant advantages of this invention will be appreciated more readily as the same becomes better understood from a reading of the following detailed description when considered in connection with the accompanying drawings, wherein like parts in each of the several figures are identified by the same reference character, and wherein:

FIG. 6 is a partial top view of the portion of the loom illustrating a part of the shed with the needle inserted therein, a cross bar support having a novel hook and leader guide wire mounted thereon together with a reciprocably movable latch needle pick mechanism;

FIG. 7 is a partial side view of the novel hook and leader guide wire mounted on the support bar showing this structure as viewed from the left hand side of FIG. 6;

FIG. 7A is a partial fragmentary view of the novel hook and leader guide wire construction illustrating the device with the needle in the position where it is withdrawn from the shed;

FIG. 8 is a front view of an improved header frame sub-assembly according to the invention;

FIG. 8A is a view of the improved header element construction employed in the improved header assembly of FIG. 8;

FIG. 10 is an end view of a novel adjustable lever bar drive sub-assembly for the take-up roll according to the invention;

FIG. 11 is a schematic illustration of the needle and reed drive sub-assembly elements employed in the loom;

FIG. 12 is a schematic diagram illustrating the components of a novel reciprocating latching needle drive sub-assembly employed in the invention;

FIG. 14 is a partial end view of the take-up and coacting pressure roller employed in the novel loom according to the invention; and FIG. 15 is a schematic illustration of the novel warp supply spool braking arrangement according to the invention.

BEST MODE OF PRACTICING INVENTION

Figure 1:
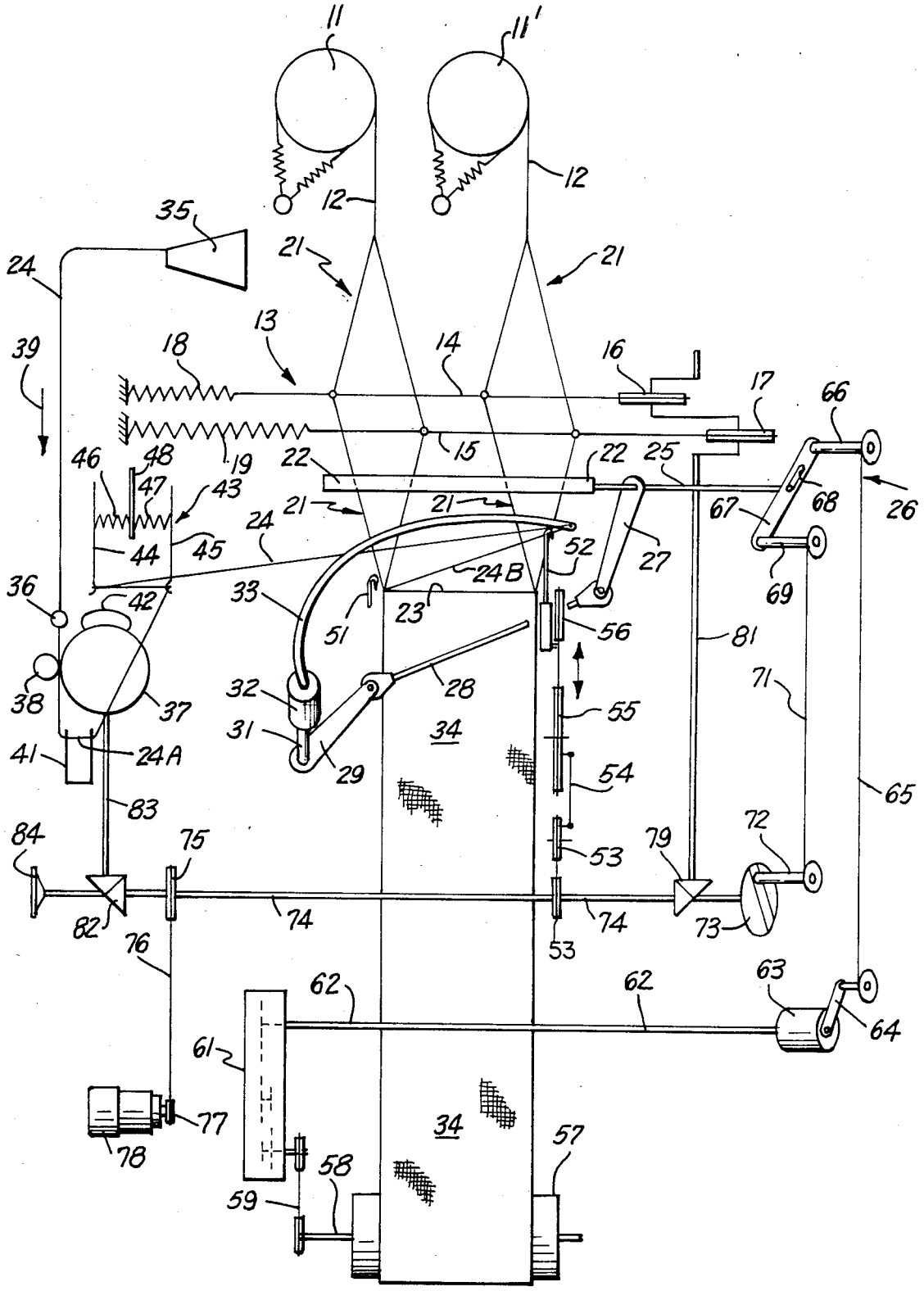
FIG. 1 is a schematic functional diagram depicting the overall improved narrow-fabric needle loom weaving system constructed according to the invention.

FIG. 1 is a detailed schematic diagram illustrating the essential component parts of the improved narrow width needle loom weaving system constructed according to the invention. In FIG. 1 a plurality of warp thread supply spools are shown at 11 and 11' and are rotatably supported for feeding warp thread shown at 12 to the loom. The warp thread of which there are normally many spread out in predesigned pattern across the width of the loom in the weft direction by means of a deflector and drop wire sub-assembly (not shown) which serve to array the plurality of warp threads in the predesigned pattern and also to detect breakages or knots therein in a manner well known to those skilled in the weaving art. From the deflector and drop wire sub-asssembly, the warp thread 12 travels to a header framc sub-assembly shown generally at 13 and comprised by at least two frames 14 and 15 which are serially arrayed along the path of movement of the warp threads 12 and extend transversely to such path. The set of serially arrayed header frames 14 and 15 are reciprocated up and down by means of eccentrically mounted drive disks 16 and 17 and coacting return springs 18 and 19, respectively. The construction and operation of the set of header frames 14 and 15 and the drive components therefor will be described more fully hereinafter. Briefly, however, it is sufficient to describe that the eccentrically mounted drive disks 16 and 17 in cooperation with the return springs 18 and 19 cause the header frames 14 to be alternately reciprocated up and down in a path which is transverse to the path of movement of the warp threads 12. For example, if the header frame 14 is assumed to be in the down position as shown in FIG. 1, the header frame 15 will be in the up position. This alternate reciprocation of the header frames 14 and 15 results in forming a shed known in the art as having a diamond-shaped pattern wherein roughly half of the warp threads 12 will be held in the up position and the remaining half held in the down position to define a diamond-shaped opening in cross section which is referred to in the art as the shed. It will be appreciated that those warp threads which form the lower side of the diamond-shaped shed during one alternate half cycle on the other alternate half cycle will form the upper side of the shed and vice versa.

The shed 21 of warp threads 12 formed in the above-described manner, extends through a reed assembly 22 and then terminates in a region generally identified as the beat-up region 23 where the reed 22 upon being driven forwardly towards the beat-up region 23 beats up the weft thread 24 in a known weaving action. The reed 22 is reciprocated back and forth within the shed region 21 between the beat-up region 23 and a withdrawn position as shown in FIG. 1 by means of a reed drive shaft 25. The reed drive shaft 25 is reciprocated by means of an adjustable lever drive sub-assembly shown at 26 to be described more fully hereafter.

A lever 27 which comprises part of a reed drive sub-assembly is keyed to the reed drive shaft 25 and is interconnected through a connecting rod 28 to a second lever 29, also comprising part of the reed drive sub-assembly. The second lever 29 is keyed to a reciprocally rotated needle drive shaft 31. A hub 32 is secured to the end of the needle drive shaft 31 and supports the needle 33 which is alternately reciprocated into and out of the shed area 21 in synchronism with the movement back and forth of reed 22. It will be appreciated that the arrangement is such that with the needle 33 in the inserted position shown in FIG. 1, that reed 22 will be in its withdrawn position. Sequentially, the needle 33 is withdrawn and the reed 22 driven forward into the beat-up region to beat-up a segment of weft thread 24 into woven cloth shown generally at 34. The weft thread 24 is supplied from a weft thread supply spool 35 through a weft thread length adjustment device 36 to be described more fully hereafter. The weft thread 24 is drawn off automatically by an automatic weft thread feed drive disk 37 which rotates synchronously with reciprocation of the reed 22 and needle 33 and has the weft thread 24 pressured between it and a pressure member 38 comprised by a truncated roller to be described more fully hereafter. The radial positioning of the weft thread 24 on the drive disk 37 is controlled by the weft thread length adjustment device 36. Rotation of the drive disk 37 causes the weft thread 24 to be moved in the direction of the arrow 39.

As the weft thread 24 leaves the drive disk 37, it passes through a pair of opposed eyelets formed in the free ends of an adjustable guide member 41 tnat straddles the periphery of drive disk 37. Drive disk 37 has a peripheral expander member 42 which can be in the form of a wire loop or otherwise secured to its periphery where it will pass between the arms of the guide member 41. As the peripheral member 42 passes between the embracing arms of guide member 41 it will cause an additional length of the weft thread 24, shown at 24A, to be drawn off thereby providing additional tensioning to the weft thread 24. The point at which the peripheral extension member 42 passes between the arms of the guide member 41 is adjusted so that the additional tensioning thus provided to the weft thread 24 occurs while the needle 33 is withdrawn from within the shed 21. The construction and operation of the automatic drive disk 37, guide member 41, length adjustor 36 and peripheral extension member 42 will be described more fully hereafter with relations to FIGS. 2 and 3 of the drawings.

The weft thread 24 after it leaves the guide member 41 travels to a weft thread support spring structure shown generally at 43 for holding the weft thread in a proper position at a suitable tension before it is led to the eye formed in the end of the needle 33. The weft thread support spring structure 43 employs a pair of opposed leaf springs 44 and 45 having slight indentations in the free ends thereof around which the weft thread is wound in its travel to the eye of the needle with the base ends of the leaf springs 44 and 45 being securely mounted in the base or frame of the weaving machine. A set of compression springs 46 and 47 act on the leaf springs 44 and 45, respectively, and are disposed between each of the leaf springs and a suitable mounting post 48 secured to the machine frame whereby most of the stress placed on the support spring structure during weaving is absorbed by the compression springs 46 and 47. The construction and operation of the support spring structure 43 will be described more fully hereinafter with relation to FIG. 5 of the drawings.

During alternate reciprocations of the free end of needle 33 into and out of the shed area 21, according to the invention, a segment of the weft thread 24B will be wound about a hook 51 as the free end of the needle enters the shed and travels towards its far end position. Hook 51 is secured to the mounting plate of the loom (not shown in FIG. 1) and which forms a gap that defines the beat-up region 23 where the weft thread segment 24B will be beaten-up with warp threads 21 by reed 22 when it is driven home into the beat-up region 23. The construction and operation of the hook 51 will be described more fully hereinafter with relation to FIGS. 6, 6A and 7 and also with relation to the alternate hook embodiment shown in FIGS. 13, 13A, 13B and 13C.

Sequentially with the arrival of the free end of the needle 33 at the far side of the shed away from hook 51, a horizontally reciprocating latching needle shown generally at 52, will be driven forwardly and will pick off the segment of weft thread 24B by means of a latching type needle of known construction and will draw that segment 24B of the weft thread downwardly as shown in FIG. 1 without breaking the weft thread, hence the segment 224B will be drawn into substantially parallel alignment with the previously beaten-up weft thread segment at right angles to the warp threads by the latching needle 52. Suostantially coincident with this action, the reed 22 will be driven home toward the beat-up region 23 and will drive this picked-off segment of weft thread 24B into the woven material 34 that results from such weaving action. The reciprocally movable latching needle 52 is reciprocated forward and back from the free end of the needle by an improved latching needle reciprocating drive comprised by a plurality of mechanical drive coupling members 53, 54 and 55 coupled to and driving a reciprocally sliding mount 56 for the latching needle 52. The construction and operation of the mechanical driving members 53–55 and latching needle 52 will be described more fully hereafter with relation to FIG. 12 of the drawings.

The woven material 34 after it has been beaten-up in the beat-up region 23 by reed 22 in the above-described manner, is drawn off by a take-up roll 57. The take-up roll 57 is rotated in a stepped manner by a take-up roll drive shaft 58 driven by coacting gears 59 from a take-up roll gear assembly 61. The take-up roll gear assembly 61 that in turn is driven by a gear assembly drive shaft 62 in a stepped manner via a one way clutch 63 on which is mounted a lever arm 64 connected by a connecting rod 65 and a mounting stud 66 to one free end of an adjustable lever arm 67. The adjustable lever arm 67 has an elongated slot 68 formed therein for adjusting the length of the lever arm which drives the connecting rod 65 and thereby adjusts the degree of rotation during each step of the take-up drum 57 as will be described more fully hereinafter with relation to FIG. 10 of the drawings.

As noted earlier, the adjustable lever arm 67 is keyed to and rotates the reed drive shaft 25 in a back and forth rocking manner. For this purpose, the remaining end of adjustable lever arm 67 has a mounting stud 69 connected thereto for rotatably supporting one end of a connecting rod 71. Connecting rod 71 has its remaining end rotatably secured to a mounting stud 72 which can be adjustably mounted on a drive disk 73 in an offset position for providing up and down reciprocation of the connecting rod 71 as disk 73 is rotated. Disk 73 is centrally keyed to a main drive shaft 74 that in turn is driven by a pulley 75 keyed to main drive shaft 74 and belt driven via belt 76 and pulley wheel 77 rotationally driven by a main drive motor 78 at a constant speed of rotation.

Figure 9:
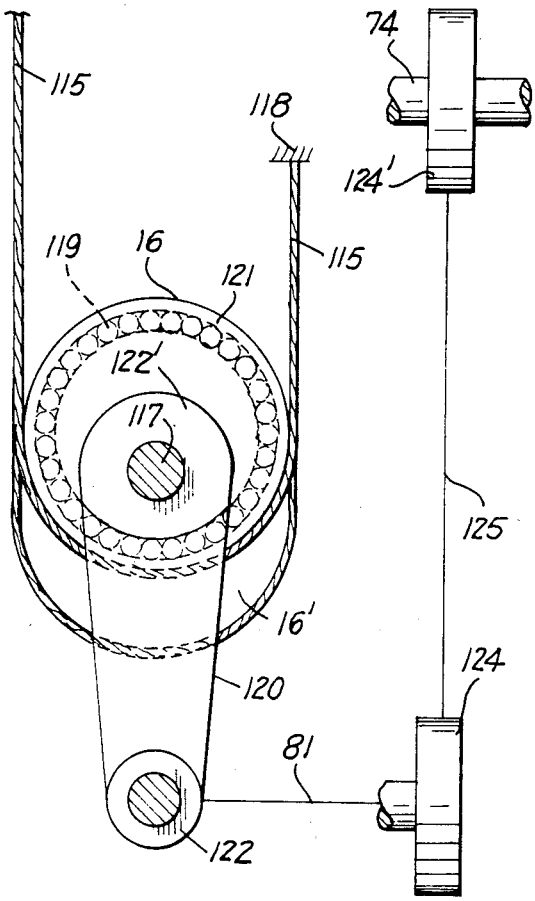
FIG. 9 is an end view in partial schematic form showing a novel header frame eccentric drive assembly according to the invention.

As is well known in the needle loom weaving art, all of the parts and sub-assemblies identified in the above description must be coordinated or synchronized in their operation so that they act together to produce the end result, namely the woven material 34. For this reason, the improved header drive assembly to be illustrated and described in greater detail with relation to FIG. 8, FIG. 8A and FIG. 9 is driven by means of a first differential coupling 79 driven by main drive shaft 74 and in turn driving a header frame assembly drive shaft 81 for rotating the eccentrically mounted drive disks 16 and 17 of the header frame drive sub-assembly. Similarly, a second differential coupling 82 drives the automatic weft feed drive disk 37 via a drive shaft 83. A manually rotatable wheel 84 allows a technician to operate all of the several interacting sub-assemblies for alignment purposes, etc., while setting up the loom for operation.

Figure 2:
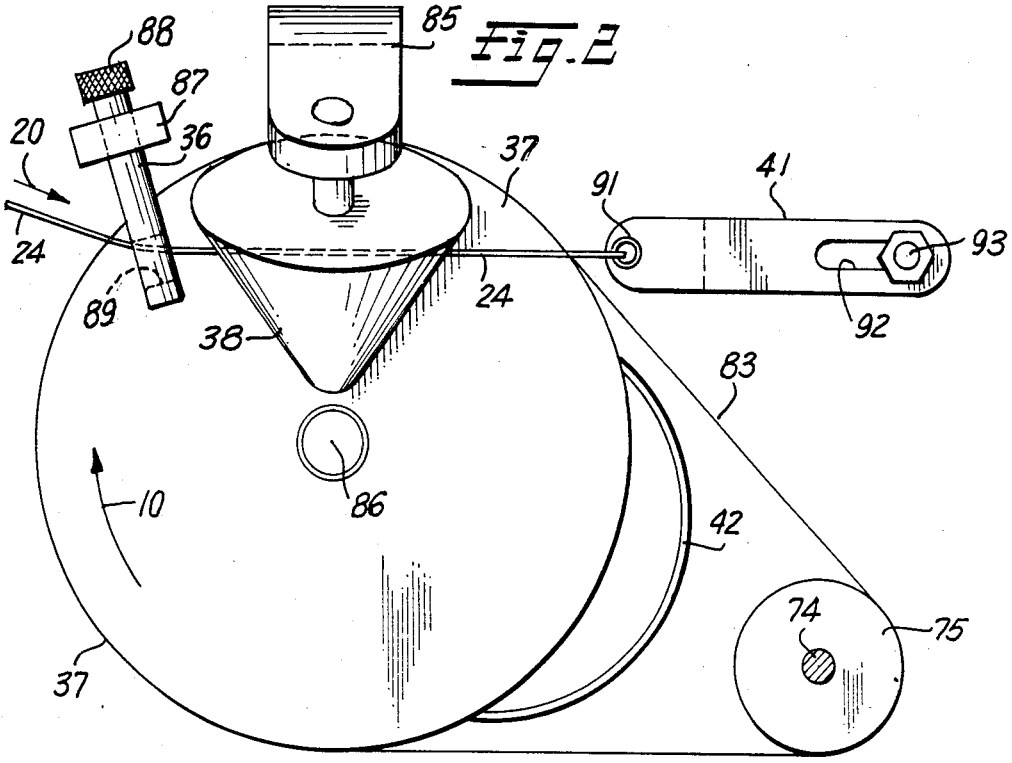
FIG. 2 is a side view of an improved weft thread automatic feed sub-assembly according to the invention.
Figure 3:
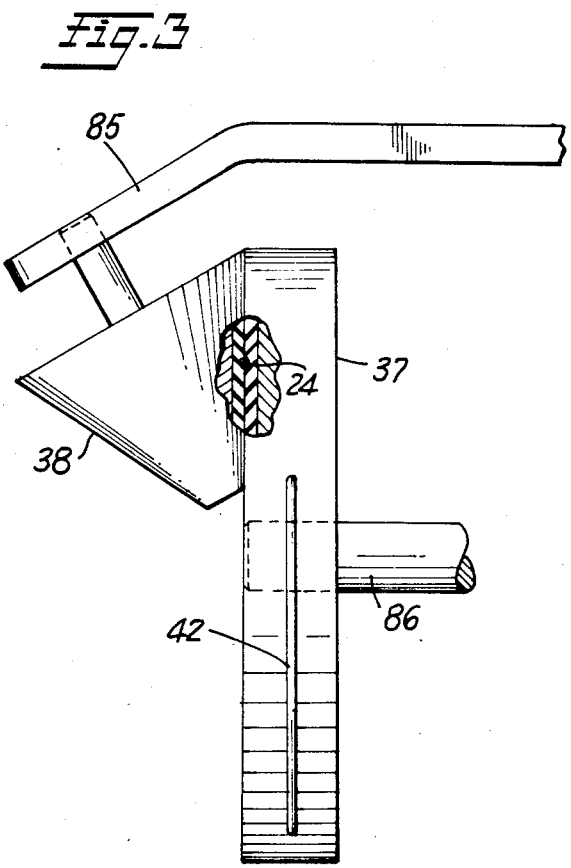
FIG. 3 is a partial top view of the automatic weft thread feed sub-assembly shown in FIG. 2.

From the above brief description it will be appreciated that the improved narrow fabric needle loom system includes a novel automatic weft thread feed sub-assembly in which the driving motor for the weft thread feed driving disk 37 may be rotated at a constant speed. This is best shown in FIG. 2 wherein it will be seen that the constant speed main shaft 74 directly drives a pulley wheel similar to 75 that forms the differential coupling 82 shown schematically in FIG. 1 and in turn directly drives the weft thread drive disk 37 through belt 83. The weft thread 24 is guided between the drive disk 37 and the pressure member 38 which is comprised oy a truncated billy roller with both tne drive disk 37 and the truncated billy roller bein rubber coated. The drive disk 37 is rotated at a constant speed in the direction of the arrow 10 oy tne belt drive 83. The truncated billy roller 38 is rotatably mounted in a support arm 85 secured to the loom housing frame in juxtaposition to drive disk 37 which is keyed to a drive disk shaft 86 that in turn is driven by a pulley wheel (not shown) via belt drive 83, the pulley 75 and the main drive shaft 74. The billy roller 38 is spring pressured into engagement with the drive disk 37 so that it is caused to follow as the drive disk 37 rotates with the weft thread 24 being compressed between the billy roller 38 and drive disk 37 in the manner best shown in FIG. 3. As a result of this arrangement, the weft thread 24 is advanced in the direction shown by the arrow 20 in FIG. 2.

To regulate the length of the weft thread being fed automatically via drive disc 37 and billy roller 38, the weft tnread 24 is guided through an elongated aperture 89 extending diametrically through a fine adjustment rod 36 mounted ahead of and adjacent to drive disk 37 just prior to the point where the weft thread is led between the drive disk 37 and the truncated billy roller 38. By this means the radial distance of the point of clamping of the weft thread 24 between the rotational center of drive disk 37, shown at 24 in FIG. 3, and the outer periphery of the drive disk, is regulated. The fine adjustment rod 36 is secured in position by a mounting block 87 and the axial position of the rod within the tubular member 36 supporting the fine adjustment rod is adjusted by rotation of the knurled knob 88 on the upper end of the rod. The fine adjustment rod is threadably seated in the tubular support 36 so that by rotation of the knurled knob end 88 the axial positioning of the end of the rod can be adjusted relative to an axially extending elongated slot 89 formed in opposite sides of the tubular member 36. The weft thread 24 is led through the diametrically opposed axially extending slot 89 in tubular member 36 so that by moving the end of the adjustment rod up and down in the above described manner, the radial positioning of weft thread 24 relative to the center of rotation 86 of drive disk 37 is obtained.

It will be appreciated that placement of the weft thread downwardly towards the center of rotation so as to shorten its radial distance from the center of rotation of the drive disk, then the greater the amount of weft thread which will be automatically fed through by the drive disk 37 and truncated billy roller 38. Conversely, by adjusting the radial positioning of weft thread 24 upwardly, then a lesser amount of weft thread will be fed by the drive disk. Hence, the distance between the pivot point of the drive disk 37 and the point of clamping of the weft thread 24 between disk 37 and billy roller 38 determines the length of weft thread feed per revolution of drive disk 37.

Figure 4:
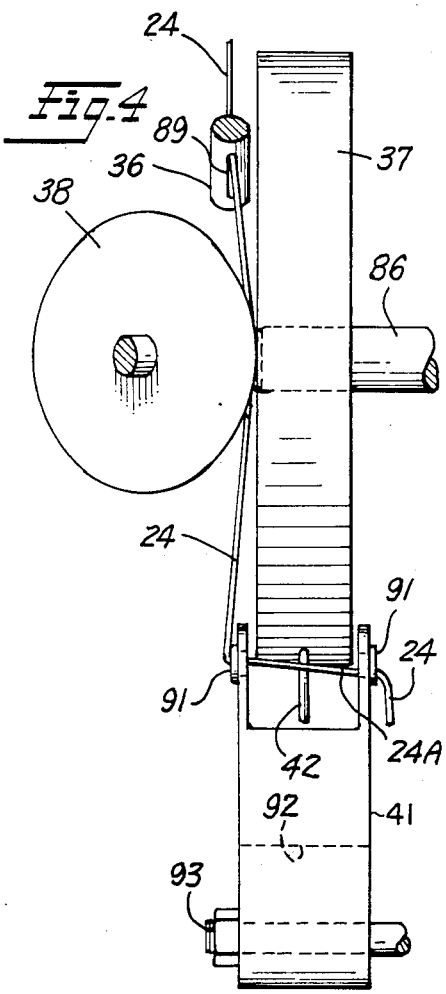
FIG. 4 is a full top view of the automatic weft thread feed sub-assembly together with attached additional weft thread tensioning device constructed according to the invention.

After leaving the drive disk 37, the weft thread is led through a pair of opposed eyelets 91 formed in the free end of an adjustably positioned guide member 41 having elongated slots 92 formed therein through which a mounting stud and nut 93 extend for securing the guide member 41 to the housing of the loom. As best shown in FIG. 4, the guide member 41 is mounted over drive disk 37 with its biforcated end containing eyelets 91 embracing drive disk 37. A periphery extension member 42 in the form of a wire loop is secured to the circumference of drive disk 37 at a particular point around its periphery for engaging the portion 24A of the weft thread during that part of the rotation of disk 37 while the periphery extension wire 42 is passing between the biforcated ends of guide member 41. Upon this occurance, the length of weft thread 24A is greatly extended in the space between the biforcated ends of the guide member 41. In a timing sense, this additional extension of the weft thread 24A occurs during that point in a cycle of reciprocation of the needle 33 while the needle 33 is outside of the shed 21. It should be noted during this part of the cycle of movement of the needle 33, there is little or no demand for weft thread. However, the drive disk 37 is being continuously rotated so that weft thread will be continued to be fed in the direction of the needle by the automatic weft thread feed disk 37. To prevent the weft thread from becoming slack during this interval, the additional periphery extension member 42 engages the weft thread segment 24A and maintains its tension. The precise point where the periphery extension member 42 engages and additionally tensions the weft thread segment 24A can be readily adjusted by means of elongated slot 92 and mounting bolt and nut 93.

Figure 5:
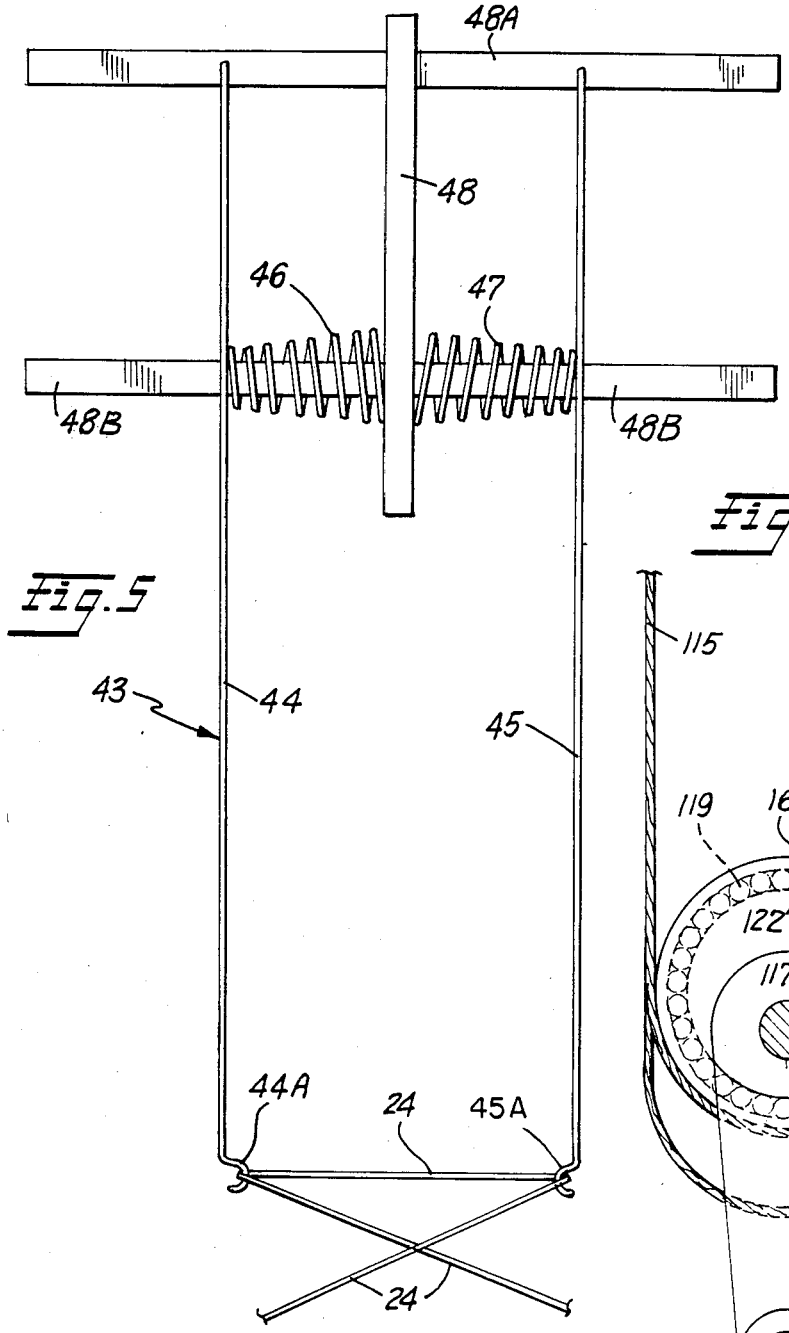
FIG. 5 is a front view of an improved weft thread spring holder constructed according to the invention.

As noted above, the novel automatic weft thread feed sub-assembly comprised by drive disk 37 and its associated parts, operates automatically to feed weft thread continuously although an irregular consumption of weft thread occurs over a full cycle of needle movement. To accommodate this irregular consumption of continuously supplied weft thread, an improved weft thread support spring structure shown generally at 43 in FIG. 5 is provided. Weft thread supply spring structures of known construction are generally comprised of two leaf spring bars such as 44 and 45 having support indentations 44A and 45A at their respective free ends for reception of the weft thread. With this arrangement, the weft thread embraces the free ends of the two spring bars 44 and 45 so that an increased weft thread demand, which occurs on insertion of needle 33 fully into the shed 21 to the pick position shown in FIG. 1, will be met by the ends of the two spring bars embraced by the weft thread being resiliently compressed together. Conversely, upon the needle 33 being withdrawn from the shed 21, the ends of the spring bar 44A and 45A embraced by the weft thread 24 will be caused to spread apart again by their spring force. For example, in the spread apart position, spacing between the two leaf springs may amount to a maximum of about 60 millimeters. In contrast, their spacing while being resiliently compressed may amount to a minimum of only 10 millimeters.

In the known prior art weft thread support spring structures, the leaf spring bars 44 and 45 alone are subjected to deflection during each cyclical movement of the needle into and out of the shed. Consequently, the bars themselves are subjected to the above-noted magnitude of pressure together and then expanded back to their initial starting position, and they tend to break in service.

In the improved weft thread spring support structure shown in FIG. 5, the spring bars 44 and 45 are pivotally mounted in a holder cross bar 48A and are guided by slots formed therein riding on the two ends of a spaced-apart frame bar 48B supported from a vertically extending support member 48 secured to the housing of the machine. The frame member 48B serves to support conically formed helical compression spring 46 and 47, which act against the leaf spring bars 44 and 45, respectively and against the central support frame member 48. As a result of this construction, during deflection of the spring bars 44 and 45 to their minimum spacing condition as described above, the helical compression springs 46 and 47 will absorb most of the elastical deformation and are designed to sustain such duty, although the leaf spring bars 44 and 45 will be subjected somewhat to deflection but no where near as much as with the prior art arrangement. Thus, it will be appreciated that the helical compression springs absorb most of the deflection action thereby conserving the resiliency of the deflection bars 44 and 45 and preventing their early failure in service.

As noted above, the distance between the spring bars 44 and 45 with the needle 33 withdrawn from shed 21 is about 60 millimeters corresponding to 6 centimeters. Under the increased weft thread demand during movement of the needle 33 into the shed 21 while weaving, the distance between the ends of the spring bars 44 and 45 is reduced to about 10 millimeters or 1 centimeter. Thus, by contraction of the free ends of the spring bars 44 and 45 embraced by the weft thread 24 on its way to the eye of the needle, an additional supply of weft thread amounting to about 10 centimeters temporarily is provided, independently of the automatic weft thread feed supplied by drive disk 37. Upon return of needle 33 to its initial starting position outside of the shed 21, the demand for the weft thread is reduced substantially to zero. This condition occurs just at about the point where the end or eye of needle 33 exits from the shed. From that point until the eye of the needle again enters the shed on the next succeeding cycle of movement, the demand for weft thread decreases substantially to zero. However, it should be recalled that the automatic weft thread drive disk 37 continues to rotate and automatically continues to feed weft thread to the spring support structure 43. It is during this interval in the needle movement cycle that the periphery extension member 42 passes between the arms of the guide member 41 and draws up the weft thread being supplied by drive disk 37 during the interval. In this manner, the weft thread 24 is maintained under suitable tension during all intevals of the cycle of movement of needle 33 into and out of shed 21 while weaving. Thus, it can be stated that while the needle is withdrawn from the shed 21, tensioning of the weft thread is maintained by passage of the additional periphery extension member 42 under the segment 24A of the weft thread extending between the biforcated end of guide arm 41.

The automatic narrow-fabric needle loom provides for double insertion of the weft thread 24 into the shed 21 formed by warp threads 12 as best shown in FIGS. 6, 6A and 7. It will be seen that the needle 33 is supported by hub 32 for swinging movement and has its free end provided with an opening or eye 33A for passage of weft thread 24. The needle 33 with the weft thread 24 passing through the eye 33A, is inserted into the shed 21 from the left side and moves to the right to the far end of the shed where it is in pick position as best seen in FIG. 6. At this point in the travel of needle 33, a knitting or latching needle 52 picks off the segment 24B of the weft thread (without breaking it) and pulls it back to beat-up position immediately adjacent the last weft thread segment that has been put in place during the previous knitting cycle of needle 33. The weft thread segment 24B is seized by the latching needle 52 at the right hand end thereof as shown in FIG. 6 through the loop produced during the preceeding weft thread picking in a weaving technique known in the art as using interlacing of the weft with the weft thread itself. To this end, a loop is produced as the right edge of the beaten-up fabric 34 as needle 33 swings back to the left to its initial starting position and the latching needle 52 will draw the last picked segment 24B of weft thread backwardly through this last mentioned loop formed at the end of the previously knitted fabric. For this end, the latching needle has provided thereon a latch 52A actuated by permanent magnet 50 during reciprocation of the latching needle 52 in a known manner as described more fully, for example, in the above-noted German Pat. No. 2940704. In operation, during the advance movement of latching needle 52 toward the eye of needle 33, the latch 52A is opened by permanent magnet 50, enabling latching needle 52 to seize the weft thread segment 24B at a point near the eye 33A of the needle. Upon return movement of the latching necdle 52, the latch 52A is closed by the permanent magnet so that the last picked weft thread segment 24B has its loop arranged in a closed eye of the latching needle 52 and can be drawn through the loop of the preceeding weft pick. During the subsequent advance movement of latching needle 52 in the next cyclical movement of needle 33, the latch 52A again will be opened by permanent magnet 50 so that needle 33 may deliver the next weft thread segment to be seized by the latching needle. As a result, at the right side of the length of the woven fabric 34, a closed selvage is obtained in a simple and known manner. As the inserted weft thread 24 always embraces the latching needle 52, a straight edge is obtained due to the fact that the weft thread 24 cannot contract the warp threads 12 during beat-up in the area of the edge due to the fact that the weft thread is still wound about the latching needle at that point in the weaving cycle.

At the left side of the length of knitted fabric 34 such a knitted selvage as described above for the right side, is not required. However, provision must be made that the points of reversal of the weft thread 24 for each pick, do not cause contraction of the warp threads 12 in the area of the left edge during beat-up. For this purpose, and as best shown in FIGS. 6, 6A and 7, a generally U-shaped hook 51 is provided which cooperates with a guide leader rod 96 to grasp and hold the left end of the weft segment 24B during beat-up thereby assuring production of a straight left edge. As best seen in FIG. 7, the U-shaped hook 51 has a long leg or shank portion and a shorter weft thread guiding leg or hook end portion 51A with the hook end portion 51A having a pointed tip. The shank portion is secured to the top plate 94A of a mounting bar having a bottom support member 94B coacting with the top 94A to form a gap 97 that defines the beat-up region where the reed 22 while being reciprocated to the right drives home the last picked weft segment 24B during beat-up to form the woven fabric 34. As shown in FIG. 7, the hook 51 is mounted on mounting bar 94A so that the hook end portion 51A is disposed immediately adjacent to and pointing at the gap 97. As shown in FIG. 6A, when the needle 33 swings to the left so that it is out of the shed 21, the weft thread segment 24B will be engaged by the leader guide wire 96 and held in position for insertion into the U-shaped hook portion of hook 51. As the needle 33 swings into shed 21 it carries the weft thread segment 24B with it and the weft thread portion 24B will embrace and be wound around the U-shaped hooked portion of hook 51 as the end 33A of the needle travels to the far side of the shed to the position shown in FIG. 6. At this point latching needle 52 grasps the weft thread segment 24B at the right hand end thereof as described above and draws it into alignment with previously beaten-up weft thread segments. This action results in causing the left hand end of the weft thread segment 24B which is wound around hook 51 to be slid along the hook end but not off of the end of the hook. During beat-up as the reed 22 drives home the weft thread, only at the end of travel of the reed 22 does the left hand side of the weft segment 24B slide off of and become free of the hook end portion 51A. The arrangement is such that the end of the hook end portion is at most only a few millimeters spaced from gap 97 to that there is no opportunity for contraction of the warp threads 12 along the left edge of the woven fabric 34 during beat-up. While the reed is in its forwardmost position driving home the last picked weft segment 24B, the needle 33 will be in the position shown in FIG. 6A. It is at this point in the travel of the needle 33 that the guide rod 96 comes into play to maintain the next succeeding weft thread segment 24B in proper alignment with the U-shaped hooked portion of hook 51. To this end a slot 98 best seen in FIGS. 6A and 7 is provided between the U-shaped hook 5 and the leader guide rod 96. The end of the last weft thread segment 24B picked will protrude from the shed 21 and will be guided through the slot 98 by the backward movement of needle 33 as best shown in FIG. 6A, until it has past beyond the short thread guiding hook end portion 51A of hook 51. Thereafter, upon movement of needle 33 back into the shed, the next succeeding weft thread segment 24B will be guided by guide rod 96 into engagement with the U-shaped hook 51 and wound therearound as described previously so that it embraces the short thread guiding hook end portion 51A during the next following weft pick by tne latching needle 52.

As described briefly above, for formation of the shed 21, the warp threads 12 are guided in a known manner through the header elements shown at 101 in FIG. 8. The header elements 101 are suspended in a header frame 14 comprised by an upper frame member 103, a lower frame member 104 and three spaced-apart vertical frame members 105 which hold frame 14 in assembled relation as shown in FIG. 8. The upper frame member 103 has extensions 103A and 103B at each end thereof and the lower frame member has extensions 104A and 104B at each of its ends. These extensions of the upper and lower frame members ride in and are guided by slots formed in opposed vertical guide plates 111 and 112 mounted on each side of the header frame assembly and having vertically extending slots formed therein for guiding reciprocal movement of the header frame 14 in an up and down manner. The vertical guide plates 111 and 112 are in turn secured to upright supports (not shown) provided on the machine frame. In the weaving machine it is usual to provide four such header frames 14 and at least two such header frames arranged in series with respect to the path of travel of the warp threads. In such an arrangement two respective ones of the header frames are moved downwardly for forming the shed 21, while the other two are moved upwardly for forming the shed as was described briefly earlier in the specification with relation to the overall system diagram shown in FIG. 1. The manner in which reciprocation of the opposite sets of the header frame 14 is achieved will be described more fully hereafter.

With regard to the design of the header elements 101, it should be noted that they have apertures 108 formed at their upper ends as shown in FIG. 8A. At the lower ends of the header elements a guide slot 109 is formed. A support rod 107 is provided in each header frame which extends between either a right or left vertical frame member 105 and an adjustable mount 106 that can be adjustably slid along the upper frame member 103. The adjustable mount 106 has an opening in the lower end thereof for supporting one end of the support rod 107 on which the header elements 101 are suspended by passing the rod 107 through the upper circular openings 108. While arranging the header elements 101 on the frames, the lower ends are first inserted over the relatively flat lower frame member 104 by means of the slots 109 and then threaded onto the support rod 107 whereby changeover of the header element when desired to reprogram the machine for a new or different pattern to be woven, is made relatively easy. Further, known header element designs provide a slot at the upper end of the element in place of the circular apertures 108 for suspension rod 107. Such slots then are slid over a upper support bar comprising a part of the header frame. With such known construction, in the past, the header elements have been known to twist under certain conditions and after thus being twisted are unable to free themselves and return to their normal vertically disposed position. With the new and improved circular aperture type of suspension for the header elements, even though the header elements might be twisted at some point in a weaving process, because of their manner of suspension after the condition causing the slight twist has passed, the header elements are able to reassume their normal vertically disposed positions.

It will also be noted in FIG. 8 that it is normal in a commercial machine to provide for the weaving of two respective narrow width ribbons, belts, labels or the like to be woven in parallel with each other on the automatic narrow fabric needle loom. When thus operated, the arrangement similar to that shown on the right hand side of each frame in FIG. 8 will be provided for the left hand side of the frame and the two respective narrow width fabrics shedded simultaneously by the same header frame assembly. Needless to say, with such an arrangement each narrow width fabric will be provided with its own weaving needle, etc. as described above and hereinafter.

FIG. 9 illustrates a new and improved header frame drive sub-assembly according to the invention. In FIG. 9, it will be seen that tne tension cord 115 attached to the center of the lower or bottom frame member 104 of header frame 14 is led around and engages an outer surface 121 of an eccentrically mounted drive disk 16. The end of the tension cord after thus being supported around drive disk 16 is then anchored at an anchor point 118 to the machine frame. A similar arrangement is provided for the tension cord (not shown) of the alternate header frame of the set of two serially arrayed header frames acting in concert by means of a second eccentrically mounted disk drive 16'. It will be noted in FIG. 9 that the two disk drives 16 and 16' for the alternate serially arrayed header frames are disposed 180 degrees apart with respect to each other and are keyed to and rotate with a disk drive shaft 117. With this arrangement, as the disk drive shaft 117 is rotated the eccentric drive disks 16 and 16' likewise will be rotated and will cause their associated header frame interconnected through the respective tension cord 115 to be reciprocated up and down with each being moved in an opposite direction from the other during each rotation of drive shaft 117. It should be further noted that rotation of the drive shaft 117 will in turn result in rotation of the inner support surface for the bearing race 119, but because of the ball bearing support provided by race 119 to the outer support surface 121 for tension cord 115, there will be no relative movement between the tension cord 115 and the outer support surface 121. Further, it should be noted that because the tension cord 115 is anchored at its free end by the anchor connection 118, there will be in fact a doubling action on the tension cord for each displacement of the eccentrically mounted drive disk 16. For example, if the eccentricity of the drive disk relative to drive shaft 117 causes the outer support surface 121 to be moved up and down a distance of say 4 centimeters, then the actual movement imparted to the header frame driven by the tension cord 115 will be doubled to 8 centimeters.

A drive shaft 117 for the eccentrically mounted drive disk 16 is rotated by means of a pulley drive arrangement including pulley belt 120 rotated by a pulley wheel 122 driven from a drive shaft 81 that in turn is rotated by a second set of pulleys 124 interconnected by pulley belt 125 and driven from the main drive shaft 74 described with relation to the overall assembly shown in FIG. 1.

The take-up roll for the woven fabric 34 is shown in FIG. 14 at 57. The fabric 34 is fed from the beat-up region 23 of the loom across a first guide roll 126 and then circumferentially around the take-up roll 57 in the direction of the arrow 127. The woven fabric 34 then is taken off take-up roll 57 by means of a second guide roll 128 and supplied to a storage space, etc. The take-up roll 57 is rotated in a step by step manner by means of a take-up roll drive shaft 58. In prior known automatic narrow-fabric needle looms, the drive of the take-up roll 57 is effected either by a ratchet mechanism or a continuously running worm gear arrangement. In the known ratchet mechanism, a driven pall steps on a ratchet wheel provided with another pall to provide a one ratchet per weft pick. This known ratchet mechanism therefore permits only a ratchet to ratchet rotation, thus stepwise and permits only a set number of picks for given length of woven material. In the continuous running worm gear arrangement, while it can provide infinitely variable adjustment for the drive of the take-up roll, it is an extremely expensive apparatus thus adding greatly to the cost of the loom.

A new and improved adjustable lever drive for the take-up roll illustrated in FIG. 10 of the drawings permits an infinitely variable adjustment for the drive of the take-up roll 57 with inexpensive mechanical coupling elements driven from main drive shaft 74. This improved take-up roll drive mechanism is effected by a crank disk 73 having a crank pin 72 mounted thereon at a distance away from the drive shaft 74 so as to provide a crank arm. Swivelly connected to the crank pin 72 is a connecting rod 71 which has its remaining end swivelly connected to a crank pin 131 secured to the end 67B of a two-armed adjustable, pivoted lever 67 mounted for pivotal movement about a trunion 132. The remaining arm 67A of the adjustable lever 67 has a connecting rod 65 pivotally supported on a stud 66 secured to the end 67A. The connecting rod 65 has the remaining end pivotally connected to a trunion on the end of a lever arm 64 that drives a one-way clutch mechanism 63 known per se in the weaving art. The one-way clutch mechanism 63 then drives a take-up roll gear assembly drive shaft 62.

With the above-described arrangement, rotation of the main drive shaft 74 causes the pivoted lever arm 67 to carry out a pivotal movement around trunion 132 whereby the connecting rod 65 is reciprocated up and down in the manner indicated by the arrow 133. The one-way clutch mechanism 63 executes an idling movement upon thrust in the downward direction of the connecting rod 65 so that no motion is imparted to the gear drive shaft 62. During the subsequent pull upward of the connecting rod 65, the gear mechanism engages the shaft 62 so that it is rotated through a predetermined angular motion Thus, the shaft 62 is rotated by respective small angular amounts for each revolution of the main drive shaft 74.

To provide infinitely variable adjustment of the angular rotation of the take-up gear assembly drive shaft 62, the second lever arm 67A of adjustable pivoted lever 67 is provided with an elongated opening 68 through which the trunion 132 extends. A nut 134 is screwed on the outer end of the trunion 132 so that by loosening the nut 64 the lever arm 67A provided to drive connecting rod 65 can be infinitely variably adjusted in a simple and efficacious manner. This in turn determines the angular movement of the take-up gear assembly drive shaft 62 for each reciprocation of connecting rod 65 and hence in effect can determine the number of picks provided by the weaving system for a given length of woven material 34.

As best shown in FIG. 1 of the drawings, the take-up gear assembly drive shaft 62 drives a reduction gear assembly 61 which in turn through a suitable take-up gear drive arrangement 59 rotates the take-up roll 57 drive shaft 58 in an infinitely adjustable manner. Thus, with every revolution of the main drive shaft 74, a weft thread segment 24B will be inserted into the shed 21 by needle 33 via a needle drive sub-assembly to be described hereafter with relation to FIG. 11 and the reed 22 will be reciprocated forward and back to beat-up the weft thread again by the drive assembly shown in FIG. 11 to be described hereafter, and the take-up roll 57 is rotated through an adjustable angular amount take-up gear drive 59 with each revolution of the main shaft 74.

It will be appreciated that by separately adjusting the amount of angular movement provided to the take-up roll 57 for each rotation of the main drive shaft 74, that the number of picks of the weft thread provided for each unit of length of woven material 34 can be infinitely variably adjusted in a simple and efficacious manner within practical limits.

The reed and needle drive sub-assembly for reciprocatingly driving the reed 22 into and back from the beat-up region and synchronously driving the needle 33 in the above-described coordinated fashion with the rotation of the take-up roll 57 and the automatic feed of weft thread by the driven disk 37, is achieved by means of a reed and needle drive shaft 25 which is connected to and rotates with the trunion 132 as best seen in FIGS. 10 and 11 of the drawings. The reed 22 is keyed to and rotates with the drive shaft 25 by means of a hub 135 that is keyed to shaft 25. A lever arm 27 extends from the hub 135 in an opposite direction from reed 22 and teminates in a crank pin 136. A connecting rod 28 is swivelly connected to the crank pin 136 at one end thereof and has the opposite end secured to a shaft 31 via a crank arm 29 and coupling 29A. The needle drive shaft 31 is supported in a bearing 137 that is secured on the housing frame of the machine with the hub 32 that mounts needle 33 being secured to the end of shaft 31. The degree of rotation of needle 33 relative to movement of the reed assembly 22 can be infinitely adjusted over a predetermined range by means of an elongated slot 138 provided in the lever arm 27.

FIG. 12 is a schematic diagram of a novel reciprocating, latching needle drive for the latching needle 52 whose function was explained in relation to the overall weaving system shown in FIG. 1 of the drawings. The latching needle drive sub-assembly is comprised by a first pulley wheel 53 keyed to the main drive shaft 74 as shown schematically in FIG. 1. Referring back to FIG. 12 it will be seen that the pulley 53 rotationally drives a cooperating pulley 53' by means of a belt 139 through a full 360 degree revolution for each revolution of the main drive shaft 74. The pulley wheel disk 53' has an eccentrically mounted pin 140 thereon to which one end of a connecting rod 54 is swivelly coupled. The remaining end of connecting rod 54 is swivelly coupled to an eccentrically mounted pin 141 secured to the outer periphery of a disk 55 that in turn drives a belt 142 via idler pulleys 143 and 144 in a reciprocating back and forth manner as indicated by the arrow 145. It will be appreciated that while the eccentric drive disk 53' is rotated through a full 360 degree revolution, the interconnection through rod 54 to eccentrically driven disk 55 is such that the eccentrically mounted pin 141 on disk 55 merely is reciprocated up and down or back and forth as shown by the arrow 145. On the portion of belt 142 adjacent the idler roller 144 and which portion is essentially maintained in a level horizontal plane by the idler rollers 143 and 144, the latching needle 52 is secured by means of a clamp 56. Latching needle 52 is designed to ride within a grooved guide base 146 secured to a base plate comprising a part of the frame of the machine and having a top plate 146A secured over the top of the groove in which the reciprocating latching needle rides. By this arrangement, rotation of the main drive shaft 74 results in back and forth horizontal reciprocation of the latching needle 52 whose latching action in conjunction with a permanent magnet 50 shown in FIG. 6, was explained fully with relation to FIG. 6.

Figure 13:
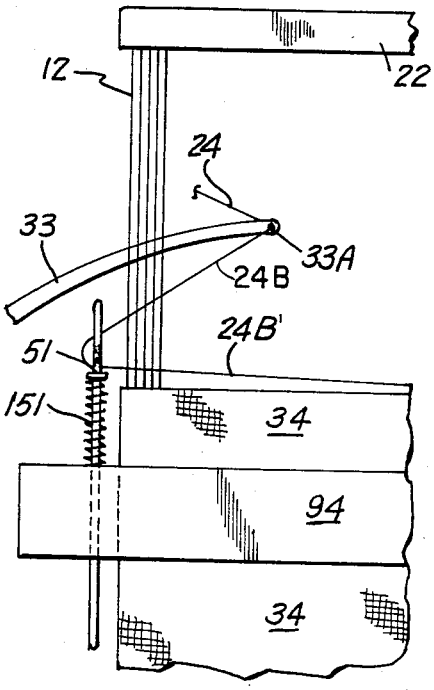
FIGS. 13, 13A, 13B and 13C illustrate a different embodiment of the novel hook selvage forming apparatus mounted on the side of the shed into which the needle of the loom enters and employed to grasp the weft thread and hold it in place relative to the beat-up region while the needle is in the shed and during beat-up.
Figure 13A:
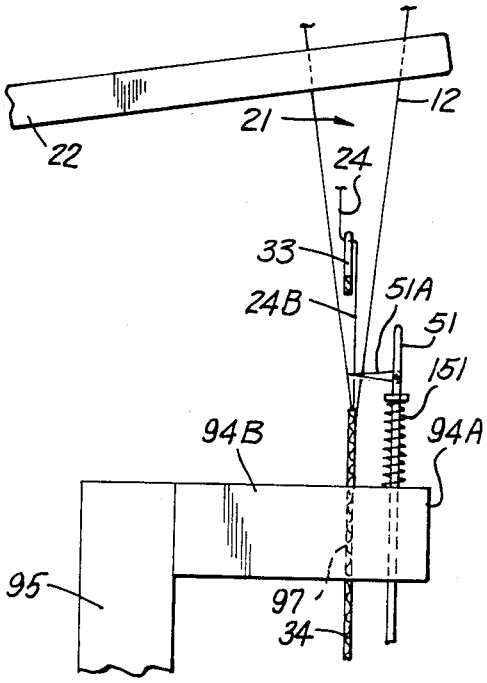
Figure 13B:
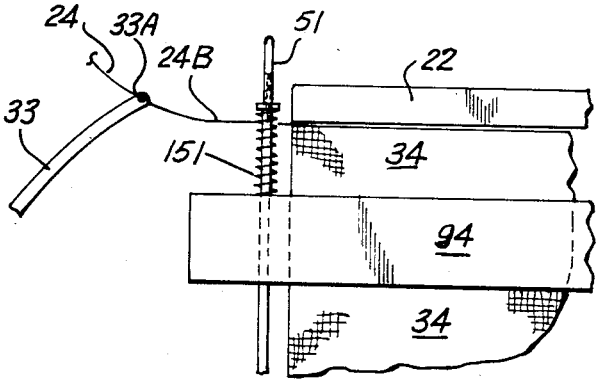
Figure 13C:
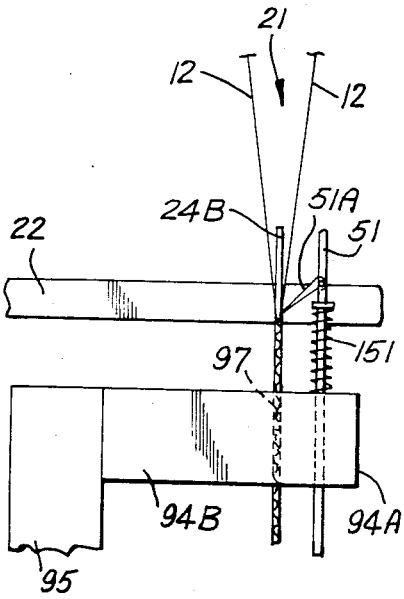

FIG. 13, FIG. 13A, FIG. 13B and FIG. 13C all illustrate an alternative embodiment of the invention which employs a different form of hook 51 for holding the weft thread segment 24B while the needle 33 travels to the far end of the shed 21 during each weaving cycle. The alternative hook construction illustrated in these figures is designed for use with very fine weft threads which are light and of small diameter. It is particularly useful while also weaving with very fine and light warp threads of small diameter. The hook 51 employed in the embodiment of the invention shown in these figures comprises a very fine, needle-like body member 51 secured in the holding blocks 94A and 94B as shown and having a pivoted hook portion 51A best seen in FIGS. 13A and 13C which normally is spring biased by a coil compression spring 151 wound around the shank portion of the needle-like hook 51 and engaging the pin-like portion 51A so as to bias it to point in a downward direction as shown in FIG. 13A. The dimensioning of the spring-loaded, pivoted hook-like pin portion 51A and mounting of the overall hook element within the support blocks 94A and 94B, is designed such that the end of the pivoted pin portion 51A is immediately adjacent to and directly opposite the gap 97 between the top 94A and the bottom 94B of the mounting block and which defines the beat-up region through which the woven fabric 34 passes after beat-up. The arrangement is such that with the reed 22 withdrawn in the position shown in FIGS. 13 and 13A, keeping in mind that FIG. 13 is a plan view while FIG. 13A is a side view from the left hand side of this portion of the loom, the needle 33 as it starts to enter the shed 21, will wind the weft thread 24 around the downwardly projected, pivoted pin portion 51A to start a new weft segment 24B. The previously formed weft segment 24B' which already will have gone through beat-up has been pulled away for convenience of illustration from the woven material 34; however, it should be kept in mind that this previously beat-up weft segment 24B' will be in close adherence to the end of the woven fabric 34 still in the beat-up region, but merely has been pulled away for convenience of illustration and description. Thereafter, the needle 33 will travel to the far end of the shed and the reciprocating latching needle will pick off the next successive weft segment 24B in the manner described earlier with relation to FIG. 6 of the drawings. After the weft segment 24B has been picked, the needle will be withdrawn to a position out of the shed as shown in FIGS. 13B and 13C and the reed 22 will be driven forwardly to the beat-up position. As the reed 22 passes the spring biased downwardly extending pivoted pin hook portion 51A, it will cause the weft segment 24B wound around the pivoted pin to pivot the pin against the force of the return spring 151 sufficiently to release this segment of the weft thread into the fell of the fabric being woven. The weft thread segment thus released is driven far enought forward by the reed during beat-up to allow the pivoted pin portion 51A to again be returned to its downwardly extended position as shown in FIG. 13A by return spring 151 as the reed is withdrawn from the beat-up region. This action is repeated with each insertion of the needle 33 into into the shed and subsequent withdrawl during the weaving process.

FIG. 15 is a schematic illustration of an improved spring biased braking arrangement for braking rotation of the warp thread supply beam employed on the new automatic needle weaving loom made available by the invention. The improved spring biased braking arrangement is applied to the warp beam on which the warp thread supply spools are mounted for rotation around a shaft 152. The improved braking arrangement is comprised by a brake cord or cable 153 which circumferentially surrounds the periphery of the warp beam 11 from which the warp thread 12 is withdrawn. It will be recalled that there will be a multiplicity of such warp beams supplying the looms so as to form the shed 21 as described earlier with relation to FIG. 1 of the drawings. One end of the warp cord 153 is secured to an anchor rod 156 by means of a tension spring 155 of appropriate construction to provide the desired tensioning of the brake cord 153 in conjunction with a coacting tension spring 155' also having one of its ends connected to the anchor rod 156. Anchor rod 156 may comprise a part of the housing or otherwise be secured to the frame of the loom. Secured intermediate the remaining end of the tension spring 155 and brake cord 153 is a tightening device 154 which can be expanded or contracted to provide for individual adjustment of the tensioning of the brake cord 153 by the combined effort of the tension springs 155 and 155'. It will be recalled that the warp thread 12 is withdrawn from the warp beam 11, under a diverter rod 157, thence led to the drop wire assembly and on to the reciprocating header frame assembly where the shed is formed as described earlier. At the downstream or output end of the shed the warp threads are beaten-up with the weft thread as described earlier and thereafter the woven material is drawn off by the take-up roll. The rate at which the weaving proceeds and the warp threads are withdrawn is determined essentially by the rate of withdrawal of the woven material by the take-up roll 57. The setting of the tension on the tension springs, both by the design of the tension springs 155 themselves and the further fine adjustment provided by the tightener device 154 will control the tension placed on the warp threads. Needless to say, if the tension is too great, the warp thread 12 may be broken and if the tension is not enough weaving difficulties will be encountered. In the known prior art arrangements for braking the warp beam of an automatic needle weaving loom, weights were depended from the periphery of the warp beam and the weights adjusted to provide desired tensioning of the warp thread. Such an arrangement however gives rise to a rather jerking motion during continuous weaving as the warp threads are continuously withdrawn. The improved spring tensioned braking arrangement shown in FIG. 15 eliminates to a great extent the magnitude of the jerking action experienced with the weighted arrangement known in the prior art.

From the foregoing description it will be appreciated that the invention provides a new and improved narrow-fabric needle loom weaving system which employs a novel arrangement of a hook secured to the mounting plate of the loom on the side thereof into which the needle enters the shed and around which the weft thread is wound in order to bend and hold the weft thread during picking on that respective side of the woven material thereby obviating the need for wires and the like in overcoming the undesirable characteristics of a hook plate arrangement known in the art. The provision of this apparatus makes possible a new method of weaving providing straighter edges with less difficulty and less material than obtainable with previously known automatic needle loom weaving systems.

The invention also provides a novel automatic weft thread feed which is effective with a simple, relatively inexpensive mechanical arrangement that is easily adjusted to vary the amount of weft thread during each pick of the weaving operation. The novel automatic weft thread feed also includes an improved support spring structure which provides tensioning support for the weft thread during movement of the needle into and out of the shed and which reduces wear of the leaf springs comprising a part of the support spring structure. The novel weft thread feed further includes an additional peripheral member for taking up slack and additionally tensioning the weft thread particularly during that portion of the travel of the needle while it is out of the shed.

The invention further provides a novel header frame assembly construction which prevents undesired twisting of the header elements and also makes it easier for a technician to change the machine over from one weaving pattern to the next by facilitating removal and replacement of the header frame elements. The new and improved header frame assembly further includes an improved, simple and relatively inexpensive eccentric drive for the header elements which simplifies and reduces cost of the overall needle loom weaving system as well as to cut down on maintenance problems normally encountered with this part of the system.

The invention further provides a novel adjustable lever arm drive for angularly rotating the take-up spool of the needle loom weaving system which is relatively simple, inexpensive in that it employs simple mechanical coupling elements and which also simplify adjustment of the number of picks provided for a given length of woven material during the weaving operation of the machine.

Additionally, the invention provides an improved reciprocating drive for the latching needle of the loom which provides in a simple and expeditious manner a linearly reciprocating movement to the latching needle during each pick.

Lastly, the invention provides an improved spring biased braking arrangement for braking rotation of the warp beam and warp thread supply spool employed on the loom.

INDUSTRIAL APPLICABILITY

The invention provides an improved narrow-fabric needle loom for automatically weaving narrow width fabrics such as ribbons, belts, labels and the like in a commercial installation for manufacturing such articles for consumption by the public.

Having described several embodiments of a new and improved narrow-fabric needle loom weaving system constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. In an improved needle loom machine for narrow width weaving comprising means for supplying warp thread, means for supplying weft thread, a header subassembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads to form the fell of the fabric at a beat-up region at the output end of the shed during each pick, and a take-up roll for withdrawing the woven material after it is beaten up in the beat-up region; the improvement comprising means for automatically feeding weft thread to the needle during reciprocal movement thereof while weaving, a hook supported on the machine on the side of the shed into which the needle enters at the near end of the travel thereof during each reciprocation, the hook having an open jaw hooked end facing the fell around which the bend in a weft thread segment is supported while the needle is at the far end of the travel thereof into the shed during each reciprocation, the end of the open jaw hooked end of the hook being terminated immediately adjacent the beat-up region where the fell is formed as close thereto as possible whereby as the reed drives home the weft thread segment during beat-up, the bend in the weft thread segment is maintained straight by the hook and is forced off the open jaw hooked end at the end of the beat-up into the fell to form a straight line selvage for the woven material, and a leader guide member mounted immediately adjacent the hook on the side thereof away from the shed and beat-up region for engaging and guiding weft thread segment into the open jaw hooked portion of the hook while the needle is withdrawn from the shed during each reciprocation thereof.

2. A needle loom machine according to claim 1 wherein the hook has the hooked end thereof depending downwardly.

3. A needle loom machine according to claim 1 wherein the hook has the hooked end thereof comprising a spring loaded pivotable pin normally extending at right angles to the shank of the hook for supporting the weft thread segment during beat-up and for being pivoted into axial alignment with the shank portion of the hook by the weft thread at the end of beat-up, the spring loaded pivotable pin being returned automatically to its right angle position relative to the shank of the hook by the spring drive upon the reed being withdrawn from the beat-up region during each weaving cycle.

4. A needle loom machine according to claim 1 wherein the beat-up region is defined by a gap formed between top and bottom woven material support members secured to a base plate mounted on the machine on the output end of the shed where the fell is formed, the hook being positioned adjacent to the pivotable support for the needle with the end of the open jaw hooked end of the hook being disposed immediately adjacent to the gap as close thereto as possible.

5. A needle loom machine according to claim 1 wherein said means for automatically feeding weft thread comprises a rotatable weft thread drive disk rotated synchronously with the movement of the needle and reed, a spring loaded weft thread pressure member in pressure contact with a rotating flat surface of the weft thread drive disk in a line extending along a radius of the disk for engaging and moving the weft thread therebetween, and a weft thread length adjustment means immediately adjacent the weft thread drive disk and weft thread pressure member for adjusting the point along the radius of the disk engaged by the weft thread to thereby adjust the length of weft thread being supplied during each rotation of the weft thread drive disk.

6. A needle loom machine according to claim 5 wherein the weft thread pressure member in pressure contact with the weft thread drive disk comprises a spring loaded truncated billy roller and wherein the weft thread length adjustment means comprises an internally threaded hollow tubular member having a threaded rod inserted in one end thereof and extending axially into the tube, the opposite end of the tubular member having opposed axially elongated slots formed therein through which the weft thread passes across the tubular member in its travel between the weft thread supply spool to the radial position on the drive disk where it is compressed between the truncated billy roller and the weft thread drive disk whereby vertical adjustment of the position of the threaded rod within the tubular member controls the length of weft thread being automatically supplied by the weft thread drive disk during rotation thereof.

7. A needle loom machine according to claim 6 further including weft thread additional tensioning means comprised by a disk periphery extension member supported on the periphery of the weft thread drive disk, a biforcated weft thread adjustable guide member having one end thereof embracing the rotatable weft thread drive disk periphery whereby the disk periphery extension member passes between the biforcated ends of the guide member, and the guide member has formed therethrough in the free end embracing the disk opposed openings defining a transverse passageway for passage of the weft thread on its path to the needle whereby the disk periphery extension member periodically engages the portion of the weft thread transversely crossing the guide member for providing additional tensioning to the weft thread while the needle is withdrawn from the shed.

8. A needle loom machine according to claim 5 further including weft thread additional tensioning means comprised by a disk periphery extension member supported on the periphery of the weft thread drive disk, a biforcated weft thread adjustable guide member having one end thereof embracing the rotatable weft thread drive disk periphery whereby the disk periphery extension member passes between the biforcated ends of the guide member, and the guide member has formed therethrough in the free end embracing the disk opposed openings defining a transverse passageway for passage of the weft thread on its path to the needle whereby the disk periphery extension member periodically engages the portion of the weft thread transversely crossing the guide member for providing additional tensioning to the weft thread while the needle is withdrawn from the shed.

9. A needle loom machine according to claim 1 wherein the means for automatically feeding weft thread to the needle during reciprocal movement thereof while weaving includes an improved spring hanger structure for supporting the weft thread being supplied to the needle, said improved spring hanger construction comprising a set of opposed, spaced-apart leaf spring arms, each of which is supported by individual compression springs acting substantially midway the length of the leaf spring arm and secured between the leaf spring arm and a suitable supporting member on the machine housing.

10. A needle loom machine according to claim 1 wherein the needle-like pick for picking off a predetermined length of weft thread from the needle during each successive insertion of the needle into the shed comprises a horizontally reciprocating latching needle movable along an axis parallel to the travel of the warp threads, said horizontally reciprocating latching needle being supported on the side of the shed opposite from the hook and reciprocating in synchronism with the movement of the needle whereby a predetermined length of weft thread is picked by the reciprocating latching needle from the needle at the end of each movement thereof into the shed.

11. A needle loom machine according to claim 10 wherein said reciprocating latching needle is driven by a reciprocatingly driven belt to which the latching needle is clamped, a grooved guide for reciprocatingly supporting the latching needle in place on the machine at the far end of the shed opposite the hook, the reciprocating belt drive being driven by a set of opposed eccentric disk drives interconnected by a connecting rod for converting rotational to reciprocating motion, one of said eccentric disk drives being rotationally driven from the main shaft by a suitable coupling.

12. A needle loom machine according to claim 1 wherein the header sub-assembly for maintaining the warp threads spread in a predesigned pattern and forming a shed has an improved eccentric drive arrangement for driving the header frames comprising the header sub-assembly, there being at least two header frames arranged in series between a deflector sub-assembly disposed between the warp thread supply spools and the header sub-assembly for spreading the warp threads into a predesigned array of parallel running paths extending through the header sub-assembly, said improved header eccentric drive including return springs secured between each side of a respective horizontal frame member of each header frame for returning the respective frame to an initial starting position, a tension cord having one end secured substantially at the center of the opposite horizontally extending frame member of each respective header frame and acting in opposition to said return springs, the tension cord for each one of the serially arranged header frames being wound around an eccentrically mounted disk drive and having the remaining end thereof secured to the machine housing, there being one such eccentrically mounted disk drive for each respective header frame, the eccentrically mounted disk drives for each set of two serially arrayed header frames being eccentrically offset at angles substantially 180 degrees apart relative to each other whereby rotation of the sets of coacting eccentrically mounted disk drives causes the respective sets of serially arrayed header frames to be moved in opposite direction relative to each other either by tensioning of the tension cord driven by a respective eccentrically mounted disk drive or by the associated return spring for the respective header frame, said header drive sub-assembly providing doubling movement action to the respective header frames for each rotation and resulting displacement of the respective associated eccentrically mounted disk drive.

13. A needle loom machine according to claim 12 wherein the respective eccentrically mounted disk drives around which the tension cords are wound, have the circumferential surfaces thereof engaging the respective tension cord wound therearound mounted in a bearing supported race whereby there is no relative movement between the respective tension cord and the surface of the respective eccentrically mounted disk drive which it engages.

14. A needle loom machine according to claim 1 wherein the header sub-assembly for maintaining the wrap thread in a predesigned pattern and forming a shed comprises a header frame assembly formed by at least two horizontal header frame bar members spaced apart in an up and down manner and reciprocatingly supported within the needle loom machine for alternate reciprocation up and down in a vertical plane of movement transverse to the direction of movement of the warp threads during weaving, said header frame assembly further including vertically extending header frame members secured to said horizontal header frame members for spacing the set horizontal frame members apart and securing all of the members together in a header frame assembly movable as a unit, said header frame assembly further including an adjustably movable upper hanger support movably mounted on the upper horizontal frame member of the header frame assembly, a header element support rod removably secured between the adjustably movable support member and a vertical frame member of the header frame, and a plurality of header elements for maintaining separation of the warp threads into desired patterns, each of the header frame elements having a circular opening at the upper end thereof for suspension from the header element support rod and having the lower end thereof grooved for insertion over the lower horizontal frame member of the header frame whereby the plurality of header elements readily may be rearranged while changing patterns.

15. A needle loom machine according to claim 14 wherein the header sub-assembly for maintaining the warp threads spread in a predesigned pattern and forming a shed has an improved eccentric drive arrangement for driving the header frames comprising the header sub-assembly, there being at least two header frames arranged in series between a deflector sub-assembly disposed between the warp thread supply spools and the header sub-assembly for spreading the warp threads into a predesigned array of parallel running paths extending through the header sub-assembly, said improved header eccentric drive including return springs secured between each side of a respective horizontal frame member of each header frame for returning the respective frame to an initial starting position, a tension cord having one end secured substantially at the center of the opposite horizontally extending frame member of each respective header frame and acting in opposition to said return springs, the tension cord for each one of the serially arranged header frames being wound around an eccentrically mounted disk drive and having the remaining end thereof secured to the machine housing, there being one such eccentrically mounted disk drive for each respective header frame, the eccentrically mounted disk drives for each set of two serially arrayed header frames being eccentrically offset at angles substantially 180 degrees apart relative to each other whereby rotation of the sets of coacting eccentrically mounted disk drives causes the respective sets of serially arrayed header frames to be moved in opposite direction relative to each other either by tensioning of the tension cord driven by a respective eccentrically mounted disk drive or by the associated return spring for the respective header frame, said header drive sub-assembly providing doubling movement action to the respective header frames for each rotation and resulting displacement of the respective associated eccentrically mounted disk drive.

16. A needle loom machine according to claim 15 wherein the respective eccentrically mounted disk drives around which the tension cords are wound, have the circumferential surfaces thereof engaging the respective tension cord wound therearound mounted in a bearing supported race whereby there is no relative movement between the respective tension cord and the surface of the respective eccentrically mounted disk drive which it engages.

17. A needle loom machine according to claim 1 furtner including an improved adjustable lever drive for the take-up roll, said improved adjustable lever take-up roll drive comprising a first driving disk coupled to and rotatable in synchronism with the main drive shaft of the needle loom machine, a first connecting rod rotatably secured to a offset position on said first driving disk, an adjustable length lever arm having an intermediate position thereon secured to and driving a needle and reed drive shaft which in turn drives respectively both the needle of the machine via intermediate coupling elements and directly drives the reed, the intermediate position of connection of the adjustable lever arm to the needle and reed drive shaft being adjustable along the axial length of the adjustable lever arm in order to set the number of picks of the latching needle per unit of length of woven material, said adjustable lever arm having said first connecting rod rotatably secured to one end thereof and a second connecting rod connected to the remaining end thereof, the opposite end of said second connecting rod being rotatably coupled to a lever arm secured to a coupling mounted on a first take-up roll drive shaft for imparting partial rotation to said first take-up roll drive shaft, the degree of partial rotation of said first take-up roll drive shaft being controlled by the intermediate positioning of said adjustable lever arm relative to said needle and reed drive shaft, said first take-up roll drive shaft being coupled through suitable coupling gears to a second take-up drive roll shaft on which the take-up drive roll is secured.

18. A needle loom machine according to claim 1 wherein said means for supplying warp thread includes warp thread supply spool tensioning means for braking rotation of the warp supply spools that supply warp thread to the machine, said warp thread supply spool tensioning means comprising a respective brake cord circumferentially surrounding each warp thread supply spool for braking the spool and adjustable tension spring means for adjustably controlling braking effort of the warp thread supply spool provided by said circumferentially surrounding brake cord, the adjustable tension spring means extending between respective ends of each brake cord and an anchor point on the machine housing.

19. A needle loom machine according to claim 4 wherein said means for automatically feeding weft thread comprises a rotatable weft thread drive disk rotated synchronously with the movement of the needle and reed, a spring loaded weft thread pressure member in pressure contact with a rotating flat surface of the weft thread drive disk in a line extending along a radius of the disk for engaging and moving the weft thread therebetween, and a weft thread length adjustment means immediately adjacent the weft thread drive disk and weft thread pressure member for adjusting the point along the radius of the disk engaged by the weft thread to thereby adjust the length of weft thread being supplied during each rotation of the weft thread drive disk.

20. A needle loom machine according to claim 19 wherein the weft thread pressure member in pressure contact with the weft thread drive disk comprises a spring loaded truncated billy roller and wherein the weft thread length adjustment means comprises an internally threaded hollow tubular member having a threaded rod inserted in one end thereof and extending axially into the tube, the opposite end of the tubular member having opposed axially elongated slots formed therein through which the weft thread passes across the tubular member in its travel between the weft thread supply spool to the radial position on the drive disk where it is compressed between the truncated billy roller and the weft thread drive disk whereby vertical adjustment of the position of the threaded rod within the tubular member controls the length of weft thread being automatically supplied by the weft thread drive disk during rotation thereof.

21. A needle loom machine according to claim 20 further including weft thread additional tensioning means comprised by a disk periphery extension member supported on the periphery of the weft thread drive disk, a biforcated weft thread adjustable guide member having one end thereof embracing the rotatable weft thread drive disk periphery whereby the disk periphery extension member passes between the biforcated ends of the guide member, and the guide member has formed therethrough in the free end embracing the disk opposed openings defining a transverse passageway for passage of the weft thread on its path to the needle whereby the disk periphery extension member periodically engages the portion of the weft thread transversely crossing the guide member for providing additional tensioning to the weft thread while the needle is withdrawn from the shed.

22. A needle loom machine according to claim 21 wherein the means for automatically feeding weft thread to the needle during reciprocal movement thereof while weaving includes an improved spring hanger structure for supporting the weft thread being supplied to the needle, said improved spring hanger construction comprising a set of opposed, spaced-apart leaf spring arms, each of which is supported by individual compression springs acting substantially midway the length of the leaf spring arm and secured between the leaf spring arm and a suitable supporting member on the machine housing.

23. A needle loom machine according to claim 22 wherein the needle-like pick for picking off a predetermined length of weft thread from the needle during each successive insertion of the needle into the shed comprises a horizontally reciprocating latching needle movable along an axis parallel to the travel of the warp threads, said horizontally reciprocating latching needle being supported on the side of the shed opposite from the hook and reciprocating in synchronism with the movement of the needle whereby a predetermined length of weft thread is picked by the reciprocating latching needle from the needle at the end of each movement thereof into the shed.

24. A needle loom machine according to claim 23 wherein said reciprocating latching needle is driven by a reciprocatingly driven belt to which the latching needle is clamped, a grooved guide for reciprocatingly supporting the latching needle in place on the machine at the far end of the shed opposite the hook, the reciprocating belt drive being driven by a set of opposed eccentric disk drives interconnected by a connecting rod for converting rotational to reciprocating motion, one of said eccentric disk drives being rotationally driven from the main shaft by a suitable coupling.

25. A needle loom machine according to claim 24 wherein the header sub-assembly for maintaining the warp thread in a predesigned pattern and forming a shed comprises a header frame assembly formed by at least two horizontal header frame bar members spaced apart in an up and down manner and reciprocatingly supported within the needle loom machine for alternate reciprocation up and down in a vertical plane of movement transverse to the direction of movement of the warp threads during weaving, said header frame assembly further including vertically extending header frame members secured to said horizontal header frame members for spacing the set horizontal frame members apart and securing all of the members together in a header frame assembly movable as a unit, said header frame assembly further including an adjustably movable upper hanger support movably mounted on the upper horizontal frame member of the header frame assembly, a header element support rod removably secured between the adjustably movable support member and a vertical frame member of the header frame, and a plurality of header elements for maintaining separation of the warp threads into desired patterns, each of the header frame elements having a circular opening at the upper end thereof for suspension from the header element support rod and having the lower end thereof grooved for insertion over the lower horizontal frame member of the header frame whereby the plurality of header elements readily may be rearranged while changing patterns.

26. A needle loom machine according to claim 25 wherein the header sub-assembly for maintaining the warp threads spread in a predesigned pattern and forming a shed has an improved eccentric drive arrangement for driving the header frames comprising the header sub-assembly, there being at least two header frames arranged in series between a deflector sub-assembly disposed between the warp thread supply spools and the header sub-assembly for spreading the warp threads into a predesigned array of parallel running paths extending through the header sub-assembly, said improved header eccentric drive including return springs secured between each side of a respective horizontal frame member of each header frame for returning the respective frame to an initial starting position, a tension cord having one end secured substantially at the center of the opposite horizontally extending frame member of each respective header frame and acting in opposition to said return springs, the tension cord for each one of the serially arranged header frames being wound around an eccentrically mounted disk drive and having the remaining end thereof secured to the machine housing, there being one such eccentrically mounted disk drive for each respective header frame, the eccentrically mounted disk drives for each set of two serially arrayed header frames being eccentrically offset at angles substantially 180 degrees apart relative to each other whereby rotation of the sets of coacting eccentrically mounted disk drives causes the respective sets of serially arrayed header frames to be moved in opposite direction relative to each other either by tensioning of the tension cord driven by a respective eccentrically mounted disk drive or by the associated return spring for the respective header frame, said header drive sub-assembly providing doubling movement action to the respective header frames for each rotation and resulting displacement of the respective associated eccentrically mounted disk drive.

27. A needle loom machine according to claim 26 wherein the respective eccentrically mounted disk drives around which the tension cords are wound, have the circumferential surfaces thereof engaging the respective tension cord wound therearound mounted in a bearing supported race whereby there is no relative movement between the respective tension cord and the surface of the respective eccentrically mounted disk drive which it engages.

28. A needle loom machine according to claim 27 further including an improved adjustable lever drive for the take-up roll, said improved adjustable lever take-up roll drive comprising a first driving disk coupled to and rotatable in synchronism with the main drive shaft of the needle loom machine, a first connecting rod rotatably secured to a offset position on said first driving disk, an adjustable length lever arm having an intermediate position thereon secured to and driving a needle and reed drive shaft which in turn drives respectively both the needle of the machine via intermediate coupling elements and directly drives the reed, the intermediate position of connection of the adjustable lever arm to the needle and reed drive shaft being adjustable along the axial length of the adjustable lever arm in order to set the number of picks of the latching needle per unit of length of woven material, said adjustable lever arm having said first connecting rod rotatably secured to one end thereof and a second connecting rod connected to the remaining end thereof, the opposite end of said second connecting rod being rotatably coupled to a lever arm secured to a coupling mounted on a first take-up roll drive shaft for imparting partial rotation to said first take-up roll drive shaft, the degree of partial rotation of said first take-up roll drive shaft being controlled by the intermediate positioning of said adjustable lever arm relative to said needle and reed drive shaft, said first take-up roll drive shaft being coupled through suitable coupling gears to a second take-up drive roll shaft on which the take-up drive roll is secured.

29. A needle loom machine according to claim 28 wherein said means for supplying warp thread includes warp thread supply spool tensioning means for braking rotation of the warp supply spools that supply warp thread to the machine, said warp thread supply spool tensioning means comprising a respective brake cord circumferentially surrounding each warp thread supply spool for braking the spool and adjustable tension spring means for adjustably controlling braking effort of the warp thread supply spool provided by said circumferentially surrounding brake cord, the adjustable tension spring means extending between respective ends of each brake cord and an anchor point on the machine housing.

30. A needle loom machine according to claim 29 wherein the hook has the hooked end thereof depending downwardly and the leader guide member is mounted immediately adjacent the hook on the side thereof away from the shed and beat-up region for guiding and holding the weft thread in the hooked portion of the hook while the needle is withdrawn from the shed.

31. A needle loom machine according to claim 29 wherein the hook has the hooked end thereof extending downwardly with the hooked end comprising a spring loaded pivotable pin for supporting the weft thread segment during beat-up and for being pivoted into axial alignment with the shank portion of the hook by the weft thread at the end of beat-up, the downwardly extending pivotable pin being returned automatically to its downwardly pointed position by the spring drive upon the reed being withdrawn from the beat-up region during each weaving cycle.

32. In an improved needle loom machine for narrow width weaving comprising means for supplying warp thread, means for supplying weft thread, a header sub-assembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads into woven fabric at a beat-up region at the output end of the shed during each pick, and a take-up roll for withdrawing the woven material after it is beaten up in the beat-up region; the improvement comprising means for automatically feeding weft thread to the needle during reciprocal movement thereof while weaving, said means for automatically feeding weft thread comprising a rotatable weft thread drive disk rotated synchronously with the movement of the needle and reed, a spring loaded weft thread pressure member in pressure contact with a rotating flat surface of the weft thread drive disk in a line extending along a radius of the disk for engaging and moving the weft thread therebetween, and weft thread length adjustment means positioned immediately adjacent and movable independently of the weft thread drive disk and the weft thread pressure member for adjusting the point along the weft thread pressure member and the radius of the disk engaged by the weft thread to thereby adjust the length of weft thread being supplied during each rotation of the weft thread drive disk.

33. A needle loom machine according to claim 32 wherein the weft thread pressure member in pressure contact with the weft thread drive disk comprises a spring loaded truncated billy roller and wherein the weft thread length adjustment means comprises an internally threaded hollow tubular member having a threaded member rod inserted in one end thereof and extending axially into the tubular member, the opposite end of the tubular member having opposed axially elongated slots formed therein through which the weft thread passes across the tubular member in its travel between the weft thread supply spool to the radial position on the drive disk where it is compressed between the truncated billy roller and the weft thread drive disk whereby vertical adjustment of the position of the threaded rod within the tubular member controls the length of weft thread being automatically supplied by the weft thread drive disk during rotation thereof.

34. A needle loom machine according to claim 33 further including weft thread additional tensioning means comprised by a disk periphery extension member supported on the periphery of the weft thread drive disk, a biforcated weft thread adjustable guide member having one end thereof embracing the rotatable weft thread drive disk periphery whereby the disk periphery extension member passes between the biforcated ends of the guide member, and the guide member has formed therethrough in the free end embracing the disk opposed openings defining a transverse passageway for passage of the weft thread on its path to the needle whereby the disk periphery extension member periodically engages the portion of the weft thread transversely crossing the guide member for providing additional tensioning to the weft thread while the needle is withdrawn from the shed.

35. A needle loom machine according to claim 34 wherein the means for automatically feeding weft thread to the needle during reciprocal movement thereof while weaving further includes an improved spring hanger structure for supporting the weft thread being supplied to the needle, said improved spring hanger construction comprising a set of opposed, spaced-apart leaf spring arms, each of which is supported by individual compression springs acting substantially midway the length of the leaf spring arm and secured between the leaf spring arm and a suitable supporting member on the machine housing.

36. A needle loom machine according to claim 32 further including weft thread additional tensioning means comprised by a disk periphery extension member supported on the periphery of the weft thread drive disk, a biforcated weft thread adjustable guide member having one end thereof embracing the rotatable weft thread drive disk periphery whereby the disk periphery extension member passes between the biforcated ends of the guide member, and the guide member has formed therethrough in the free end embracing the disk opposed openings defining a transverse passageway for passage of the weft thread on its path to the needle whereby the disk periphery extension member periodically engages the portion of the weft thread transversely crossing the guide member for providing additional tensioning to the weft thread while the needle is withdrawn from the shed.

37. In an improved needle loom machine for narrow width weaving comprising means for supplying warp thread, means for supplying weft thread, a header sub-assembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads into woven fabric at a beat-up region at the output end of the shed during each pick, and a take-up roll for withdrawing the woven material after it is beaten up in the beat-up region; the improvement comprising warp thread supply spool tensioning means for braking rotation of the warp supply spools that supply warp thread to the machine, said warp thread supply spool tensioning means comprising a respective brake cord circumferentially surrounding each warp thread supply spool for braking the spool and adjustable tension spring means for adjustably controlling braking effort of the warp thread supply spool provided by said circumferentially surrounding brake cord, the adjustable tension spring means extending between respective ends of each brake cord and an anchor point on the machine housing.

38. In an improved needle loom machine for narrow width weaving comprising means for supplying warp thread, means for supplying weft thread, a header sub-assembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads into woven fabric at a beat-up region at the output end of the shed during each pick, and a take-up roll for withdrawing the woven material after it is beaten up in the beat-up region; the improvement comprising an improved header sub-assembly for maintaining the warp thread in a predesigned pattern and forming a shed, said improved header sub-assembly comprising a header frame assembly formed by at least two horizontal header frame bar members spaced apart in an up and down manner and reciprocatingly supported within the needle loom machine for alternate reciprocation up and down in a vertical plane of movement transverse to the direction of movement of the warp threads during weaving, said header frame assembly further including vertically extending header frame members secured to said horizontal header frame members for spacing the set of horizontal frame members apart and securing all of the members together in a header frame assembly movable as a unit, said header frame assembly further including an adjustably movable upper hanger support movably mounted on the upper horizontal frame member of the header frame assembly, a header element support rod removably secured between the adjustably movable support member and a vertical frame member of the header frame, and a plurality of header elements for maintaining separation of the warp threads into desired patterns, each of the header frame elements having a circular opening at the upper end thereof for suspension from the header element support rod and having the lower end thereof grooved for insertion over the lower horizontal frame member of the header frame whereby the plurality of header elements readily may be rearranged while changing patterns.

39. In an improved needle loom machine for narrow width weaving comprising means for supplying warp thread, means for supplying weft thread, a header sub-assembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads into woven fabric at a beat-up region at the output end of the shed during each pick, and a take-up roll for withdrawing the woven material after it is beaten up in the beat-up region; the improvement comprising an improved header sub-assembly for maintaining the warp threads spread in a predesigned pattern and forming a shed and having an improved eccentric drive arrangement for driving the header frames comprising the header sub-assembly, there being at least two header frames arranged in series between a deflector sub-assembly disposed between the warp thread supply spools and the header sub-assembly for spreading the warp threads into a predesigned array of parallel running paths extending through the header sub-assembly, said improved header eccentric drive including return springs secured between each side of a respective horizontal frame member of each header frame for returning the respective frame to an initial starting position, a tension cord having one end secured substantially at the center of the opposite horizontally extending frame member of each respective header frame and acting in opposition to said return springs, the tension cord for each one of the serially arranged header frames being wound around an eccentrically mounted disk drive and having the remaining end thereof secured to the machine housing, there being one such eccentrically mounted disk drive for each respective header frame, the eccentrically mounted disk drives for each set of two serially arrayed header frames being eccentrically offset at angles substantially 180 degrees apart relative to each other whereby rotation of the sets of coacting eccentrically mounted disk drives causes the respective sets of serially arrayed header frames to be moved in opposite direction relative to each other either by tensioning of the tension cord driven by a respective eccentrically mounted disk drive or by the associated return spring for the respective header frame, said header drive sub-assembly providing doubling movement action to the respective header frames for each rotation and resulting displacement of the respective associated eccentrically mounted disk drive.

40. A needle loom machine according to claim 39 wherein the respective eccentrically mounted disk drives around which the tension cords are wound, have the circumferential surfaces thereof engaging the respective tension cord wound therearound mounted in a bearing supported race whereby there is no relative movement between the respective tension cord and the surface of the respective eccentrically mounted disk drive which it engages.

41. In an improved needle loom machine for narrow width weaving comprising means for supplying warp thread, means for supplying weft thread, a header sub-assembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads into woven fabric at a beat-up region at the output end of the shed during each pick, and a take-up roll for withdrawing the woven material after it is beaten up in the beat-up region; the improvement comprising an improved adjustable lever drive for the take-up roll drive comprising a first driving disk coupled to and rotatable in synchronism with the main drive shaft of the needle loom machine, a first connecting rod rotatably secured to a offset position on said first driving disk, an adjustable length lever arm having an intermediate position thereon secured to and driving a needle and reed drive shaft which in turn drives respectively both the needle of the machine via intermediate coupling elements and directly drives the reed, the intermediate position of connection of the adjustable lever arm to the needle and reed drive shaft being adjustable along the axial length of the adjustable lever arm in order to set the number of picks of the latching needle per unit of length of woven material, said adjustable lever arm having said first connecting rod rotatably secured to one end thereof and a second connecting rod connected to the remaining end thereof, the opposite end of said second connecting rod being rotatably coupled to a lever arm secured to a coupling mounted on a first take-up roll drive shaft for imparting partial rotation to said first take-up roll drive shaft, the degree of partial rotation of said first take-up roll drive shaft being controlled by the intermediate positioning of said adjustable lever arm relative to said needle and reed drive shaft, said first take-up roll drive shaft being coupled through suitable coupling gears to a second take-up roll shaft on which the take-up drive roll is secured.

42. An improved method of operating a needle loom machine for narrow width weaving of the type comprising means for supplying warp thread, means for supplying weft thread, a header sub-assembly for maintaining the warp thread spread in a predesigned pattern and forming a shed, a reciprocally movable needle for insertion of the weft thread into the shed during each successive pick, a needle-like pick for picking off a predetermined length of weft thread from the needle during each successive insertion of the needle in the shed at the far end of the travel thereof, a reed assembly for beating-up the warp and weft threads into a fell of woven fabric at a beat-up region at the output end of the shed during each pick, and a take-up roll for withdrawing the woven material after it is beaten-up in the beat-up region; said method comprising automatically feeding weft thread to the needle during reciprocal movement thereof while weaving, providing a hook-like support on the machine on the side of the shed into which the needle enters at the near end of the travel thereof during each reciprocation, the hook-like support having an open jaw hooked end around which the weft thread is supported while the needle is at the far end of the travel within the shed during each reciprocation thereof, the open jaw hooked end being terminated immediately adjacent the beat-up region as close to the fell of the fabric as possible whereby as the reed drives home the weft thread during beat-up, the weft thread segment being beaten-up is supported by the hooked end of the hook and then is forced off the hooked end at the end of the beat-up to form a straight line selvage for the woven material, and providing a leader guide member mounted immediately adjacent the hook on the side thereof away from the shed for engaging and guiding a segment of the weft thread into the open jaw hooked portion of the hook while the needle is withdrawn from the shed during each reciprocation thereof.

43. The method according to claim 42 wherein the hook has the hooked end thereof extending downwardly with the hooked end comprising a spring loaded pivotable pin for being pivoted into axial alignment with the shank portion of the hook by the weft thread during beat-up, the downwardly extending pivotable pin being returned automatically to its downwardly pointed position by the spring drive upon the reed being withdrawn from the beat-up region during each weaving cycle.

44. The method according to claim 42 further comprising automatically feeding weft thread by means of a rotatable weft thread drive disk rotated sychronously with the movement of the needle and a spring loaded weft thread pressure member in pressure contact with a rotating flat surface of the weft thread drive disk in a line extending along a radius of the disk for engaging and moving the weft thread therebetween, and adjusting the weft thread length at a point immediately adjacent the weft thread drive disk and weft thread pressure member by adjusting the radial distance at which the weft thread engages the drive disk during rotation of the weft thread drive disk.

45. The method according to claim 44 further including additionally tensioning the weft thread by a disk periphery extension member supported on the periphery of the weft thread drive disk, providing a biforcated weft thread adjustable guide member having one end thereof embracing the rotatable weft thread drive disk periphery whereby the disk periphery extension member passes between the biforcated ends of the guide member, and the guide member has formed therethrough in the free end embracing the disk opposed openings defining a transverse passageway for passage of the weft thread on its path to the needle whereby the disk periphery extension member periodically engages the portion of the weft thread transversely crossing the guide member for providing additional tensioning to the weft thread while the needle is withdrawn from the shed.

46. The method according to claim 45 further comprising providing an improved spring hanger structure for supporting the weft thread being supplied to the needle by means of a set of opposed, spaced-apart leaf spring arms, each of which is supported by individual compression springs acting substantially midway the length of the leaf spring arm and secured between the leaf spring arm and a suitable supporting member on the machine housing.

47. The method according to claim 46 wherein the needle-like pick for picking off a predetermined length of weft thread from the needle during each successive insertion of the needle into the shed comprises a horizontally reciprocating latching needle movable along an axis parallel to the travel of the warp threads, said horizontally reciprocating latching needle being supported on the side of the shed opposite that side through which the needle enters and reciprocating in synchronism with the movement of the needle whereby a predetermined length of weft thread is picked by the reciprocating latching needs from the needle at the end of each movement thereof into the shed.

48. The method according to claim 47 wherein said reciprocating latching needle is driven by a reciprocatingly driven belt to which the latching needle is clamped, a grooved guide for reciprocatingly supporting the latching needle in place on the machine at the far end of the shed opposite the hook, is provided with the reciprocating belt drive being driven by a set of opposed eccentric disk drives interconnected by a connecting rod for converting rotational to reciprocating motion, one of said eccentric disk drives being rotationally driven from the main shaft by a suitable coupling.

49. The method according to claim 48 wherein the header sub-assembly for maintaining the warp thread in a predesigned pattern and forming a shed comprises a header frame assembly formed by at least two horizontal header frame bar members spaced apart in an up and down manner and reciprocatingly supported within the needle loom machine for alternate reciprocation up and down in a vertical plane of movement transverse to the direction of movement of the warp threads during weaving, said header frame assembly further including vertically extending header frame members secured to said horizontal header frame members for spacing the set horizontal frame members apart and securing all of the members together in a header frame assembly movable as a unit, said header frame assembly further including an adjustable movable upper hanger support movably mounted on the upper horizontal frame member of the header frame assembly, a header element support rod removably secured between the adjustably movable support member and a vertical frame member of the header frame, and a plurality of header elements for maintaining separation of the warp threads into desired patterns, each of the header frame elements having a circular opening at the upper end thereof for suspension from the header element support rod and having the lower end thereof grooved for insertion over the lower horizontal frame member of the header frame whereby the plurality of header elements readily may be rearranged while changing patterns.

50. The method according to claim 49 wherein the header sub-assembly for maintaining the warp threads spread in a predesigned pattern and forming a shed is driven by an improved eccentric drive arrangement for driving the header frames comprising the header sub-assembly, there being at least two header frames arranged in series between a deflector sub-assembly disposed between the warp thread supply spools and the header sub-assembly for spreading the warp threads into a predesigned array of parallel running paths extending through the header sub-assembly, the improved header eccentric drive including return springs secured between each side of a respective horizontal frame member of each header frame for returning the respective frame to an initial starting position, providing a tension cord having one end secured substantially at the center of the opposite horizontally extending frame member of each respective header frame and acting in opposition to said return springs, the tension cord for each one of the serially arranged header frames being wound around an eccentrically mounted disk drive and having the remaining end thereof secured to the machine housing, there being one such eccentrically mounted disk drive for each respective header frame, the eccentrically mounted disk drives for each set of two serially arrayed header frames being eccentrically offset at angles substantially 180 degrees apart relative to each other whereby rotation of the sets of coacting eccentrically mounted disk drives causes the respective sets of serially arrayed header frames to be moved in opposite direction relative to each other either by tensioning of the tension cord driven by a respective eccentrically mounted disk drive or by the associated return spring for the respective header frame, said header drive sub-assembly providing doubling movement action to the respective header frames for each rotation and resulting displacement of the respective associated eccentrically mounted disk drive.

51. The method according to claim 50 wherein the respective eccentrically mounted disk drives around which the tension cords are wound, have the circumferential surfaces thereof engaging the respective tension cord wound therearound mounted in a bearing supported race whereby there is no relative movement between the respective tension cord and the surface of the respective eccentrically mounted disk drive which it engages.

52. The method according to claim 51 further including providing an improved adjustable lever drive for the take-up roll, said improved adjustable lever take-up roll drive comprising a first driving disk coupled to and rotatable in synchronism with the main drive shaft of the needle loom machine, a first connecting rod rotatably secured to an offset position on said first driving disk, an adjustable length lever arm having an intermediate position thereon secured to and driving a needle and reed drive shaft which in turn drives respectively both the needle of the machine via intermediate coupling elements and directly drives the reed, the intermediate position of connection of the adjustable lever arm to the needle and reed drive shaft being adjustable along the axial length of the adjustable lever arm in order to set the number of picks of the latching needle per unit of length of woven material, said adjustable lever arm having said first connecting rod rotatably secured to one end thereof and a second connecting rod connected to the remaining end thereof, the opposite end of said second connecting rod being rotatably coupled to a lever arm secured to a coupling mounted on a first take-up roll drive shaft for imparting partial rotation to said first take-up roll drive shaft, the degree of partial rotation of said first take-up roll drive shaft being controlled by the intermediate positioning of said adjustable lever arm relative to said needle and reed drive shaft, said first take-up roll drive shaft being coupled through suitable coupling gears to a second take-up drive roll shaft on which the take-up drive roll is secured.

53. The method according to claim 52 further including providing warp thread supply spool tensioning means for braking rotation of the warp supply spools that supply warp thread to the machine, said warp thread supply spool tensioning means comprising a respective brake cord circumferentially surrounding each warp thread supply spool for braking the spool and adjustable tension spring means for adjustably controlling braking effort of the warp thread supply spool provided by said circumferentially surrounding brake cord, the adjustable tension spring means extending between respective ends of each brake cord and an anchor point on the machine housing.

* * * * *